US009709257B2

(12) United States Patent
Wu

(10) Patent No.: US 9,709,257 B2
(45) Date of Patent: Jul. 18, 2017

(54) RECESSED LIGHT APPARATUS

(71) Applicant: Liangju Wu, Foshan (CN)

(72) Inventor: Liangju Wu, Foshan (CN)

( * ) Notice: Subject to any disclaimer, the term of this patent is extended or adjusted under 35 U.S.C. 154(b) by 0 days.

(21) Appl. No.: 14/787,267

(22) PCT Filed: Dec. 20, 2013

(86) PCT No.: PCT/CN2013/090053

§ 371 (c)(1),
(2) Date: Oct. 26, 2015

(87) PCT Pub. No.: WO2014/173153

PCT Pub. Date: Oct. 30, 2014

(65) Prior Publication Data

US 2016/0084488 A1 Mar. 24, 2016

(30) Foreign Application Priority Data

Apr. 26, 2013 (CN) ..... 2013 1 0175389
Jun. 28, 2013 (CN) ..... 2013 1 0287254

(51) Int. Cl.

| | |
|---|---|
| ***F21S 8/04*** | (2006.01) |
| ***F21V 29/15*** | (2015.01) |
| ***F21V 25/12*** | (2006.01) |
| ***F21S 8/02*** | (2006.01) |
| ***F21V 21/04*** | (2006.01) |
| ***F21V 29/77*** | (2015.01) |
| ***F21V 29/70*** | (2015.01) |

(52) U.S. Cl.

CPC ..... *F21V 29/15* (2015.01); *F21S 8/026* (2013.01); *F21S 8/04* (2013.01); *F21V 21/044* (2013.01); *F21V 21/049* (2013.01); *F21V 25/12* (2013.01); *F21V 29/70* (2015.01); *F21V 29/777* (2015.01)

(58) Field of Classification Search

CPC ..... F21V 29/777; F21V 21/049; F21V 21/042
USPC ..... 362/364, 365, 373
See application file for complete search history.

(56) References Cited

U.S. PATENT DOCUMENTS

2010/0214790 A1* 8/2010 Wu ..... F21S 8/02 362/364

* cited by examiner

*Primary Examiner* — Andrew Coughlin
*Assistant Examiner* — Keith Delahoussaye
(74) *Attorney, Agent, or Firm* — Raymond Y. Chan; David and Raymond Patent Firm

(57) ABSTRACT

A recessed light apparatus for being installed at a ceiling includes a light source unit, a heat sink for dissipating heat generated from the light source unit, and a thermal insulating member coupled between the heat sink and the light source unit to define an upper space above the heat insulating member and a bottom space below the thermal insulating member. In case of fire, the heat insulating member prevents flame or fire spreading from the bottom space to the upper space.

6 Claims, 20 Drawing Sheets

RECESSED LIGHT APPARATUS

CROSS REFERENCE OF RELATED APPLICATION

This is a non-provisional application that claims priority to PCT application, international application number PCT/CN2013/090053, international filing date Dec. 20, 2013, which claims priority to Chinese application, application number CN103363408A, and filing date Apr. 26, 2013.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a lighting fixture, and more particularly to a recessed light apparatus adapted for being embedded into a fireproof ceiling panel, which comprises a thermal insulating element for preventing heat being conducted to the beam structure and/or plank in case of fire, so as to prevent the ceiling collapse caused by carbonization or combustion of the beam structure.

Description of Related Arts

Recessed light fixtures are common lighting fixture and found in a building, wherein after the installation of the recessed light fixture, the recessed light fixture is embedded in the ceiling surface for indoor illumination. A conventional recessed light fixture generally comprises a light housing, a base disposed in the light housing, and a light emitting element supported at the base within the light housing for light generation. Generally speaking, the specification of the recessed light fixture is generally configured in 2.5 inches, 3 inches, 4 inches, 5 inches or 6 inches in diameter size. For installation, an installing opening must be formed at the ceiling for fitting the recessed light fixture, such that the recessed light fixture can be coupled at the ceiling through the installing opening and can be supported by the beam structure above the ceiling. Since the recessed light fixture is installed into the ceiling, the ceiling structure will be damaged. In other words, the ceiling panel, especially the fireproof ceiling panel, will be damaged by forming the installing opening and mounting the recessed light fixture thereat. Therefore, the damaged ceiling panel will lose or reduce its fireproof capability. In addition, the beam structure is designed as a frame support of the building. When the recessed light fixture is installed to couple at the beam structure as a support, the strength of the beam structure will be weakened. Since the beam structure does not have any thermal insulation ability or low thermal insulation ability, the heat from the recessed light fixture will transmit to the beam structure. In case of fire, the flame or fire will spread to the beam structure through the recessed light fixture. Once the beam structure is damaged or burnt, the beam structure will lose its supporting ability and the ceiling will be collapsed.

SUMMARY OF THE PRESENT INVENTION

The invention is advantageous in that it provides a recessed light apparatus to be installed into a ceiling, which comprises a thermal insulating member as an insulating partition to define an upper space above the thermal insulating member and a bottom space below the thermal insulating member for preventing or slowing down the flame or fire spreading from the bottom space to the upper space so as to prevent the heat transmitting to the beam structure at the upper space.

Another advantage of the invention is to provide a recessed light apparatus, which comprises a heat sink and a light source unit directly or indirectly mounted at a bottom portion of the heat sink.

Another advantage of the invention is to provide a recessed light apparatus, wherein the heat sink comprises an extension portion detachably coupled at the bottom portion of the heat sink through a threaded structure. Accordingly, the light source unit is provided at the extension portion, such that the heat from the light source unit can be effectively transmitted to the heat sink.

Another advantage of the invention is to provide a recessed light apparatus, wherein the heat sink further has a heat conducting slot formed at the bottom portion of the heat sink and an installing portion formed at the extension portion of the heat sink, The installing portion is tightly contacted within the heat conducting slot via the threaded structure for ensuring the heat transmission so as to effectively transmit the light source unit to a heat dissipating portion of the heat sink.

Another advantage of the invention is to provide a recessed light apparatus, wherein the heat sink is made of solid material having high thermal conductivity.

Another advantage of the invention is to provide a recessed light apparatus, which comprises a heat conductive element for transmitting heat from the light source unit to the heat sink to reduce the heat accumulated at the light source unit, so as to ensure the normal operation of the light source unit at an optimum working temperature and to prolong the service life span of the light source unit.

Another advantage of the invention is to provide a recessed light apparatus, which comprises a first thermal expansion member, wherein when the heat conductive element is detached from the light source unit at high temperature, the first thermal expansion member is self-expanded to block a heat conducting channel. Therefore, in case of fire, the heat conducting channel is blocked to prevent the flame or fire spreading through the heat conducting channel above the ceiling.

Another advantage of the invention is to provide a recessed light apparatus, wherein the thermal insulating member is outwardly extended from the heat conductive element to couple to the ceiling so as to separate the heat sink from the ceiling. In case of fire, the thermal insulating member will block or slow down the flame or fire spreading out to the ceiling and the beam structure, so as to prevent the ceiling from being collapsed.

Another advantage of the invention is to provide a recessed light apparatus, which comprises a light casing having a receiving cavity to receive the heat sink therein.

Another advantage of the invention is to provide a recessed light apparatus, wherein the light casing is coupled at and supported by the thermal insulating member, such that the light casing is separated from the ceiling to prevent or slow down the heat being dissipated by the light casing to the ceiling and the beam structure.

Another advantage of the invention is to provide a recessed light apparatus, which does not involve any complicated structure or manufacturing process, such that the recessed light apparatus has the advantages of simplified structural configuration, low manufacturing cost, and easy to use.

Additional advantages and features of the invention will become apparent from the description which follows, and may be realized by means of the instrumentalities and combinations particular point out in the appended claims.

According to the present invention, the foregoing and other objects and advantages are attained by a recessed light apparatus for installing into a ceiling, comprising:

a light source unit adapted for being operatively connected to an external power source;

a heat sink; and a heat conductive element extended between the light source unit and the heat sink for transmitting heat generated by the light source unit to the heat sink.

In accordance with another aspect of the invention, the present invention comprises a ceiling light apparatus being installing into a ceiling, comprising:

a heat sink for dissipating heat from a light source unit; and a thermal insulation arrangement comprising a thermal insulating member coupled at a bottom portion of the heat sink to define an upper space above the heat insulating member and a bottom space below the thermal insulating member for preventing flame or fire spreading from the bottom space to the upper space.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
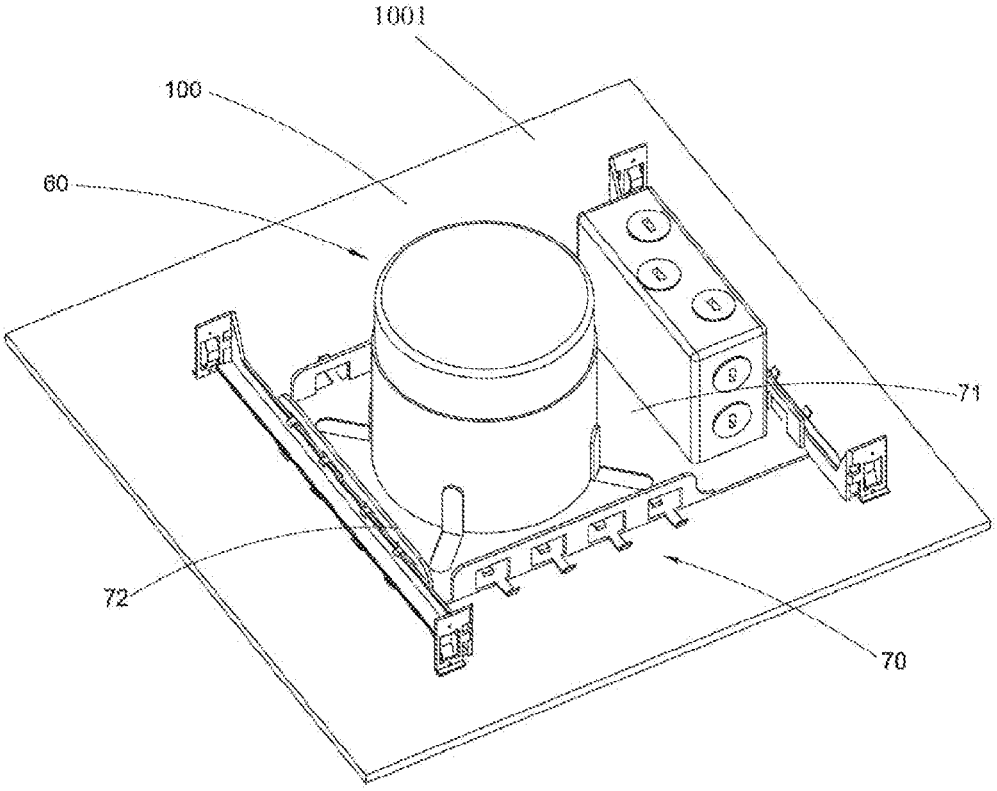
FIG. 1 is a perspective view of a recessed light apparatus according to a first preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 1 to 5B of the drawings, a recessed light apparatus according to a first preferred embodiment of the present invention is illustrated, wherein the ceiling light apparatus, such as a recessed light apparatus, comprises a light source unit 10, at least a heat conductive element 20, and at least a heat sink 30. The light source unit 10 is arranged for electrically connected to an external power source for operation. The heat conductive element 20 is extended from the light source unit 10 to the heat sink 30 for thermally conducting the heat generated from the light source unit 10 to the heat sink 30. Preferably, the heat conductive element 20 is upwardly extended from the light source unit 10 to the heat sink 30, such that the heat generated from the light source unit 10 can be effectively conducted to the heat sink 30. Accordingly, the light source unit 10 comprises at least a light emitting element 12, wherein when the light source unit 10 is electrified via the external power source, the light emitting element 12 will emit light energy. In other words, the heat conductive element 20 is located between the light source unit 10 and the heat sink 30, such that the heat generated from the light source unit 10 can be effectively conducted to the heat sink 30. In particular, the heat conductive element 20 is thermally contacted between the light source unit 10 and the heat sink 30.

It is worth mentioning that the recessed light apparatus should not be limited as a ceiling light apparatus, which can serve as a wall light or the like to be installed into a supporting surface. In addition, the recessed light apparatus should not be limited as a light generation device, which can serve as other visible light or invisible light apparatus, such as UV sterilization device.

The light source unit 10 further comprises a light base 11, wherein the light emitting element 12 is supported at the light base 11. It is worth mentioning that the light emitting element 12 should not be limited as a thermal radiation and light emission source, such as an incandescent light emitting element, halogen light emitting element, glass reflective light emitting element, or energy saving light emitting element, gas discharging light source, such as fluorescent light emitting element or sodium, mercury and metal halide light emitting element, solid state light source, such as light emitting diode (LED) or organic light emitting diode (OLED), or other forms of light emitting element. Preferably, the light emitting element 12 of the present invention is light emitting diode (LED).

The heat conductive element 20 has an enlarged base portion 21 and an elongated heat conducting portion 22 upwardly extended from the base portion 21, wherein a size of the base portion 21 is larger than a size of the heat conducting portion 22. In particular, the base portion 21 of the heat conductive element 20 is thermally contacted with the light base 11 of the light source unit 10 for thermally conducting the light emitting element 12 at the light base 11 to the heat conducting portion 22 of the heat conductive element 20, so as to thermally transmit the heat to the heat sink 30 through the heat conducting portion 22. In other words, the base portion 21 of the heat conductive element 20 is thermally contacted with the light base 11 of the light source unit 10 while the heat conducting portion 22 of the heat conductive element 20 is thermally contacted with the heat sink 30. Then, the heat transmitted to the heat sink 30 will effectively be dissipated and released in the surrounding environment.

Figure 3A:
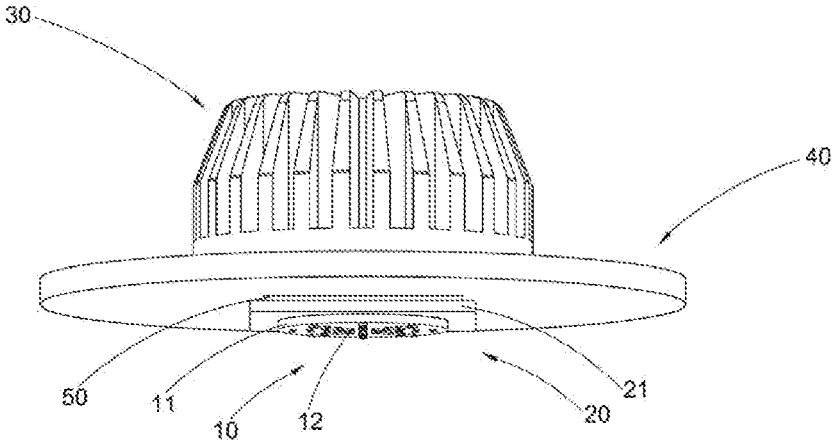
FIG. 3A is a perspective view of the recessed light apparatus according to the above first preferred embodiment of the present invention, illustrating heat being transmitted from the light emitting element to the heat sink.
Figure 3B:
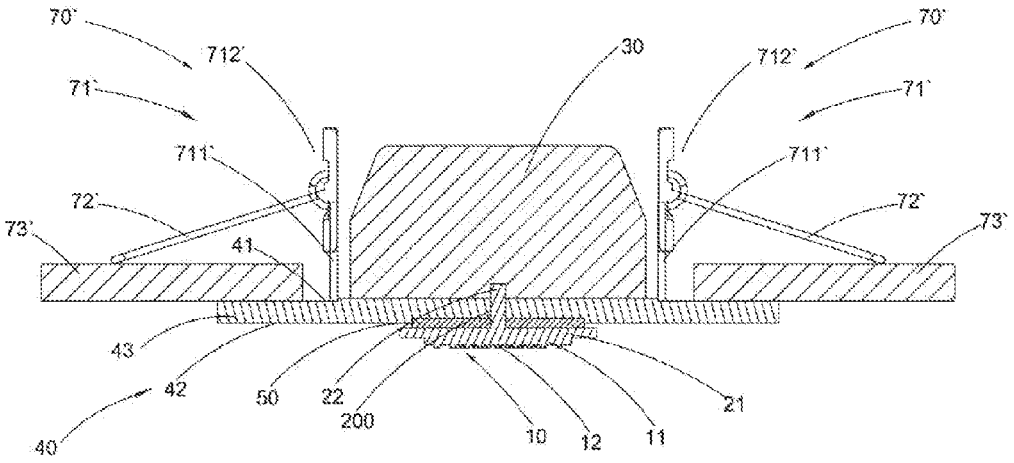
FIG. 3B is a sectional view of the recessed light apparatus according to the above first preferred embodiment of the present invention, illustrating the supporting frame.

In particular, as shown in FIG. 3B, a heat conducting channel 200 is formed between the light source unit 10 and the heat sink 30, wherein the heat conducting portion 22 of the heat conductive element 20 is extended along the heat conducting channel 200 to contact with the heat sink 30, so as to guide the heat to the heat sink 30.

It is worth mentioning that the base portion 21 and the heat conducting portion 22 of the heat conductive element 20 are made of high thermal conductivity material. Preferably, the thermal conductivity of the heat conductive element 20 should not be lesser than 10 W/m·K. The heat conductive element 20 is made of solid material having the thermal conductivity not lesser than 10 W/m·K for heat conduction. Preferably, heat conductive element 20 is made of solid material having the thermal conductivity not lesser than 300 W/m·K. For example, the heat conductive element 20 can be made of copper or copper alloy having the thermal conductivity not lesser than 300 W/m·K.

Figure 2:
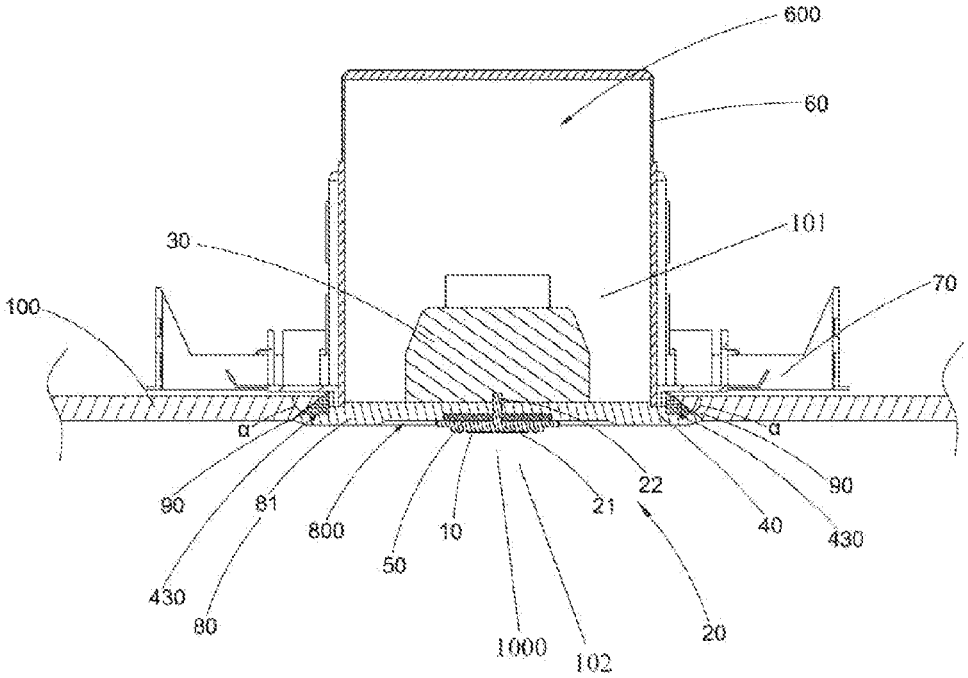
FIG. 2 is a sectional view of the recessed light apparatus according to the above first preferred embodiment of the present invention.

As shown in FIGS. 2 to 3A, the recessed light apparatus of the present invention further comprises a thermal insulating member 40 provided between the heat sink 30 and the heat conductive element 20. In particular, the thermal insulating member 40 is provided between the heat sink 30 and the base portion 21 of the heat conductive element 20, wherein the heat conducting portion 22 of the heat conductive element 20 is extended through the thermal insulating member 40 to couple with the heat sink 30, such that the thermal insulating member 40 is radially and outwardly extended from the heat conducting portion 22 of the heat conductive element 20 in a horizontal manner. In addition, the thermal insulating member 40 serves as an insulating panel extended to the ceiling 100 for not only separating the light source unit 10 from the ceiling 100 but also separating the heat sink 30 from the ceiling 100. As a result, the thermal insulating member 40 not only prevents the heat from the light source unit 10 transmitting to the ceiling 100 but also prevents the heat from the heat sink 30 transmitting to the ceiling 100, so as to prevent overheat of the ceiling. It is worth mentioning that the thermal insulating member 40 is made of low thermal conductivity material, such as gypsum, solid material containing magnesium, solid material containing magnesium chloride, glass beads, or other heat resistance materials. Accordingly, the thermal insulating member 40 is made of material having thermal conductivity lesser than 10 W/m·K. Preferably, the thermal insulating member 40 is made of material having thermal conductivity lesser than 1 W/m·K. For the best modification, the thermal insulating member 40 is made of material having thermal conductivity lesser than 0.1 W/m·K.

As shown in FIGS. 2 to 3A, the recessed light apparatus of the present invention further comprises a first thermal expansion member 50 provided between the heat conductive element 20 and the thermal insulating member 40. In particular, the first thermal expansion member 50 is embedded in the thermal insulating member 40 and is located between the thermal insulating member 40 and the base portion 21 of the heat conductive element 20, wherein the heat conducting portion 22 of the heat conductive element 20 is extended through the thermal insulating member 40 and the first thermal expansion member 50 to couple with the heat sink 30, such that the first thermal expansion member 50 is radially and outwardly extended from the heat conducting portion 22 of the heat conductive element 20 in a horizontal manner. Accordingly, a width of the first thermal expansion member 50 is smaller than a width of the light base 11 of the light source unit 10 which is smaller than a width of the thermal insulating member 40.

It is worth mentioning that the first thermal expansion member 50 is made of thermal expansion material, wherein the linear thermal expansion coefficient thereof must be smaller than 2, preferably smaller than 3, under 70° C. to 1000° C. It is preferred that the linear thermal expansion coefficient of the first thermal expansion member 50 is smaller than 5. When the light source unit 10 and the heat conductive element 20 are detached or melted at high temperature, the first thermal expansion member 50 will be self-expanded to block the heat conducting channel 200 so as to prevent the flame or fire spreading from the bottom side of the first thermal expansion member 50 through the heat conducting channel 200 to the upper side of the thermal insulating member 40. In other words, the first thermal expansion member 50 can slow down the flame or fire being rapidly spread out to the upper space of the ceiling through the present invention.

As shown in FIGS. 1 and 2, the recessed light apparatus of the present invention further comprises a light casing 60 having a receiving cavity 600 and a bottom opening. The thermal insulating member 40 has an upper side 41, a bottom side 42, and a peripheral portion 43, wherein a bottom opening edge of the light casing 60 is coupled at the upper side 41 of the thermal insulating member 40, such that the heat sink 30 is received in the receiving cavity 600 of the light casing 60. Accordingly, the light casing 60 further has an outer wall surface 61 and an inner wall surface 62, wherein the inner wall surface 62 of the light casing 60 defines the receiving cavity 600 and does not contact with the heat sink 30. In other words, the receiving cavity 600 of the light casing 60 provides a heat dissipating space for dissipating the heat from the heat sink 30. It is worth mentioning that the peripheral portion of the thermal insulating member 40 is outwardly extended out of the outer wall surface 61 of the light casing 60.

It is worth mentioning that the thermal insulating member 40 is radially and outwardly extended from the heat conducting portion 22 of the heat conductive element 20 to define the peripheral portion 43 of the thermal insulating member 40 out of the light source unit 10 and the light casing 60, so as to separate the light casing 60 from the ceiling 100. The peripheral portion 43 of the thermal insulating member 40 is arranged to couple with the ceiling 100. Therefore, the heat dissipated from the light casing 60 will not directly transmit to the ceiling 100, so as to prevent the overheat of the ceiling 100 during heat dissipation.

As shown in FIGS. 1 and 2, the recessed light apparatus of the present invention further comprises a supporting frame 70 radially extended from the outer wall surface 61 of the light casing 60 to the ceiling 100 to support the light source unit 10 at the ceiling 100. Accordingly, the supporting frame 70 comprises a supporting panel 71 radially and outwardly extended from the outer wall surface 61 of the light casing 60 towards the ceiling 100, wherein the supporting panel 71 is made of high thermal conductivity solid material to dissipate the heat from the heat dissipating space of the light casing 60 to the surrounding environment.

The supporting frame 70 further comprises a supporting member 72 extended from the supporting panel 71 for coupling at a beam structure above the ceiling 100, so as to retain the desired location of the supporting panel 71 at the ceiling 100.

It is worth mentioning that the light casing 60 is also made of high thermal resistance material that the receiving cavity 600 of the light casing 60 serves as a fire-proof cavity for preventing the flame or fire spreading out from the upper side of the ceiling 100. The melting point of the light casing 60 should not be lower than 1000° C.

Figure 3C:
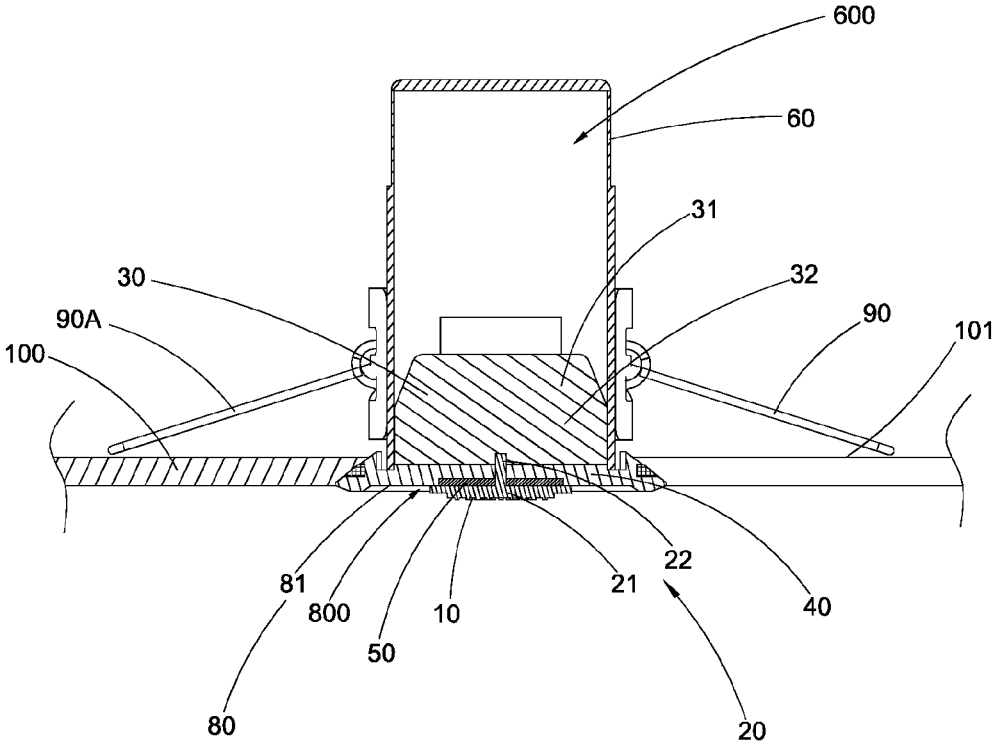
FIG. 3C is a sectional view of the recessed light apparatus according to the above first preferred embodiment of the present invention, illustrating the resilient frame.

FIG. 3C illustrate the light casing 60 according to the preferred embodiment, wherein the heat sink 30 has a heat dissipating portion 31 and a bottom portion 32 downwardly extended therefrom. The light casing 60 is coupled at the bottom portion 32 of the heat sink 30 and is extended upwardly. Preferably, the recessed light apparatus further comprises a resilient frame 90A, which comprises a plurality of resilient arms, extended from the light casing 60 for applying an outward and upward resilient force against an opening rim 1001 of the ceiling 100 when the recessed light apparatus is installed at the ceiling 100, so as to retain the position of the recessed light apparatus at the ceiling 100. Preferably, the thermal insulating member 40 is provided at the bottom portion 32 of the heat sink 30 to define an upper space 101 above the thermal insulating member 40 and a bottom space 102 below the thermal insulating member 40. Therefore, the thermal insulating member 40 can effectively prevent the flame or fire spreading from the bottom space 102 to the upper space 101.

Figure 5A:
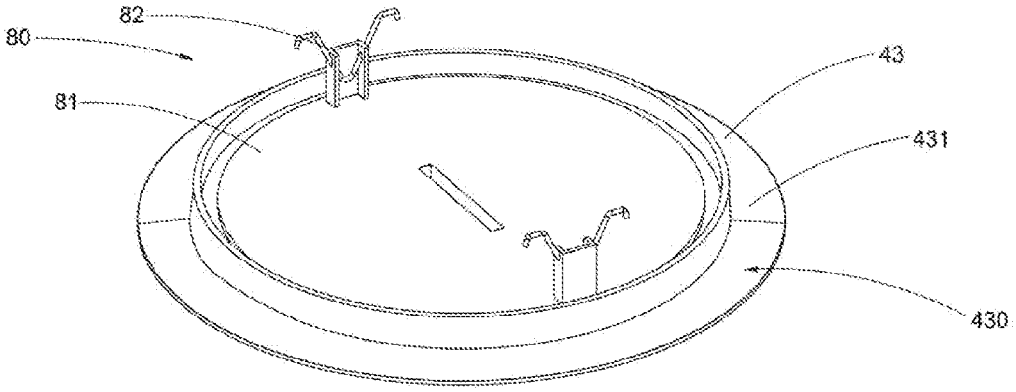
FIG. 5A is a perspective view of a face cover of the recessed light apparatus according to the above first preferred embodiment of the present invention.

As shown in FIGS. 2 and 5A, the ceiling 100 has an installing opening 1000 formed at a ceiling panel as part of the ceiling, wherein the recessed light apparatus is coupled thereat. The thermal insulating member 40 is radially and outwardly extended from the heat conducting portion 22 of the heat conductive element 20 in a horizontal manner for separating the heat sink 30 from the ceiling 100. In particular, the peripheral portion 43 of the thermal insulating member 40 forms a peripheral surface 431 for coupling with the ceiling 100. In other words, the peripheral surface 431 of the thermal insulating member 40 will increase the contact surface area to the ceiling 100 to secure the thermal insulating member 40 at the ceiling 100. In addition, the opening rim 1001 of the installing opening of the ceiling 100 has an inclined surface to define an angle $\alpha$ with respect to the peripheral surface 431 of the thermal insulating member 40. The angle $\alpha$ can be an acute angle or an obtuse angle. The angle $\alpha$ is preferred to be configured either smaller than 60° or larger than 150°. Preferably, the angle $\alpha$ is smaller than 60°. The thermal insulating member 40 is radially extended from the heat sink 30 to the ceiling 100 in order to cover the installing opening 1000 of the ceiling 100. Preferably, the peripheral surface 431 of the thermal insulating member 40 is overlapped under the opening rim 1001 of the ceiling 100 to enclose the installing opening 1000 of the ceiling 100.

It is worth mentioning that when the angle $\alpha$ is smaller than 60°, the ceiling 100 will serve as a support of the recessed light apparatus to support and retain the recessed light apparatus in position.

As shown in FIGS. 2 and 5A, the recessed light apparatus of the present invention further comprises a second thermal expansion member 90, wherein the thermal insulating member 40 has a peripheral cavity 430 formed at the peripheral portion 43 and above the peripheral surface 431. In particular, the peripheral cavity 430 is indented at the peripheral portion 43, such that the peripheral cavity 430 is formed at the peripheral portion 43 of the thermal insulating member 40. The second thermal expansion member 90 is received at the peripheral cavity 430 to encircle around the peripheral portion 43 of the thermal insulating member 40. Therefore, when the thermal insulating member 40 is coupled at the ceiling 100, the second thermal expansion member 90 is located between the ceiling 100 and the peripheral surface 431 of the thermal insulating member 40. During the thermal expansion of the second thermal expansion member 90, the expanded second thermal expansion member 90 will fill up the clearance between the thermal insulating member 40 and the ceiling 100 to block the flame or fire to pass through the clearance between the peripheral portion 43 of the thermal insulating member 40 and the ceiling 100.

Figure 4:
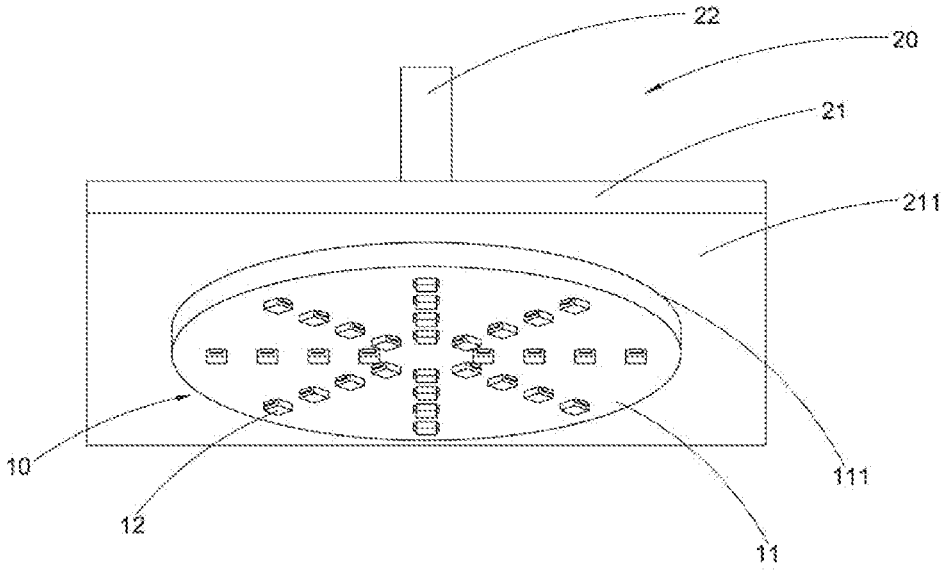
FIG. 4 is a perspective view of the recessed light apparatus according to the above first preferred embodiment of the present invention, illustrating heat being transmitted from the light emitting element to the heat conductive element.

As shown in FIG. 4, the base portion 21 of the heat conductive element 20 is upwardly extended from the light base 11 of the light source unit 10, wherein the light base 11 of the light source unit 10 has an upper base surface 111 thermally contacting with a bottom base surface 211 of the base portion 21 of the heat conductive element 20. In particular, a surface area of the bottom base surface 211 of the base portion 21 of the heat conductive element 20 is larger than a surface area of the upper base surface 111 of the light base 11 of the light source unit 10. Therefore, the heat generated from the light emitting element 12 at the light base 11 can be effectively transmitted to the heat sink 30 through the heat conductive element 20.

In addition, the heat conducting portion 22 of the heat conductive element 20 is upwardly extended from the base portion 21 thereof, wherein the heat conducting portion 22 of the heat conductive element 20 has a planar structure to increase a surface area thereof to effectively transmit the heat to the heat sink 30. It is worth mentioning that the heat conducting portion 22 of the heat conductive element 20 is upwardly extended from a center of the base portion 21 to the heat sink 30. It is appreciated that the base portion 21 of the heat conductive element 20 can be integrated with the light base 11 of the light source unit 10 to form a one piece integrated member. Preferably, the heat conducting portion 22 of the heat conductive element 20 is integrally extended from the base portion 21 thereof. Accordingly, the heat conductive element 20 can be directly welded to the light base 11 of the light source unit 10. There is no filler filled between the heat conductive element 20 and the light source unit 10. In other words, the heat conductive element 20 is directly connected to the light base 11 of the light source unit 10 for increasing the thermal transmission conductivity of the heat conductive element 20 to effectively transmit the heat from the light source unit 10 to the heat sink 30.

Figure 5B:
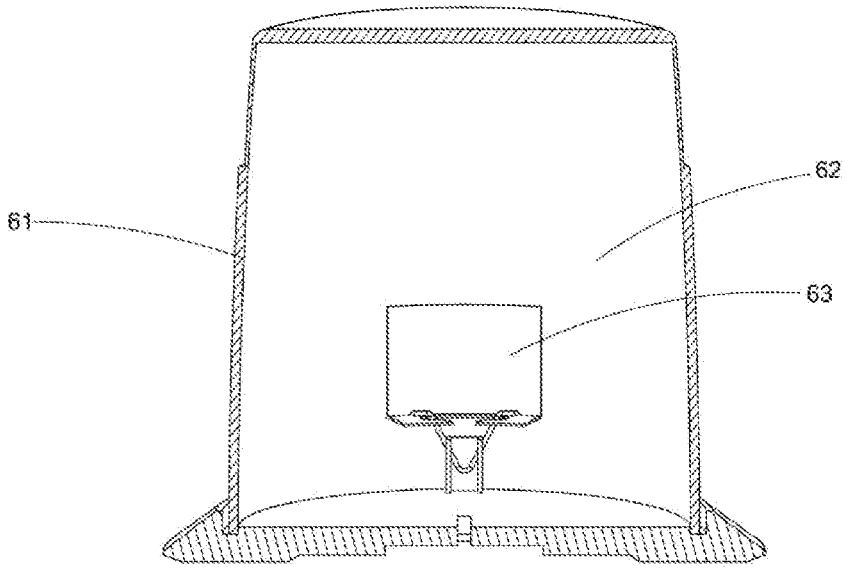
FIG. 5B is a sectional view of the light housing and the face cover of the recessed light apparatus according to the above first preferred embodiment of the present invention.

As shown in FIGS. 5A and 5B, the recessed light apparatus further comprises a face cover 80 provided under the thermal insulating member 40, wherein the face cover 80 has a cover opening 800 in FIG. 2, wherein the light from the light source unit 10 will pass through the cover opening 800 to the area below the ceiling 100 for illumination.

In particular, the face cover 80 comprises a cover panel 81 and a cover connector 82 upwardly extended from the cover panel 81, wherein the light casing 60 further comprises a coupler 63 provided at the inner wall surface 62. Accordingly, the cover connector 82 is upwardly extended from a peripheral edge of the cover panel 81 to detachably couple the coupler 63 of the light casing 60, so as to detachably secure the face cover 80.

FIG. 3B illustrates an alternative mode of the supporting frame 70' which comprises an affixing member 71', a resilient member 72', and a retainer 73'. The affixing member 71' has an affixing end 711' extended from the thermal insulating member 40 and spaced apart from the heat sink 30, and a supportive end 712' upwardly extended from the affixing end 711'. The resilient member 72' is outwardly extended from the supportive end 712' of the affixing member 71' to the retainer 73', wherein the retainer 73' can be moved with respect to the resilient member 42'. In particular, the resilient member 72' is pressed on the retainer 73' to apply a downward pressing force thereon to ensure the retainer 73' to overlap on the peripheral portion 43 of the thermal insulating member 40. Accordingly, the width of the retainer 73' is larger than the width of the thermal insulating member 40, such that the inner peripheral portion of the retainer 73' is overlapped on the peripheral portion 43 of the thermal insulating member 40. Therefore, when the recessed light apparatus is installed into the ceiling, the retainer 73' will press on the ceiling 100 via the resilient force of the resilient member 72', such that the rim of the ceiling 100 can be sandwiched between the retainer 73' and the peripheral portion 43 of the thermal insulating member 40 via the resilient force of the resilient member 72'.

As shown in FIGS. 6 to 10, a recessed light apparatus according to a second embodiment illustrates an alternative mode of the first embodiment, wherein the recessed light apparatus comprises a light source unit 10A, at least a heat conductive element 20A, and at least a heat sink 30A. The light source unit 10A is arranged for electrically connected to an external power source for operation. The heat conductive element 20A is extended from the light source unit 10A to the heat sink 30A for thermally conducting the heat generated from the light source unit 10A to the heat sink 30A. Preferably, the heat conductive element 20A is upwardly extended from the light source unit 10A to the heat sink 30A, such that the heat generated from the light source unit 10A can be effectively conducted to the heat sink 30A. Accordingly, the light source unit 10A comprises at least a light emitting element 12A, wherein when the light source unit 10A is electrified via the external power source, the light emitting element 12A will emit light energy. In other words, the heat conductive element 20A is located between the light source unit 10A and the heat sink 30A, such that the heat generated from the light source unit 10A can be effectively conducted to the heat sink 30A. In particular, the heat conductive element 20A is thermally contacted between the light source unit 10A and the heat sink 30A.

The light source unit 10A further comprises a light base 11A, wherein the light emitting element 12A is supported at the light base 11A. It is worth mentioning that the light emitting element 12A should not be limited as a thermal radiation and light emission source, such as an incandescent light emitting element, halogen light emitting element, glass reflective light emitting element, or energy saving light emitting element, gas discharging light source, such as fluorescent light emitting element or sodium, mercury and metal halide light emitting element, solid state light source, such as light emitting diode (LED) or organic light emitting diode (OLED), or other forms of light emitting element. Preferably, the light emitting element 12A of the present invention is light emitting diode (LED).

The heat conductive element 20A has a base portion 21A and a heat conducting portion 22A upwardly extended from the base portion 21A. In particular, the base portion 21A of the heat conductive element 20A is thermally contacted with the light base 11A of the light source unit 10A for thermally conducting the light emitting element 12A at the light base 11A to the heat conducting portion 22A of the heat conductive element 20A, so as to thermally transmit the heat to the heat sink 30A through the heat conducting portion 22A. In other words, the base portion 21A of the heat conductive element 20A is thermally contacted with the light base 11A of the light source unit 10A while the heat conducting portion 22A of the heat conductive element 20A is thermally contacted with the heat sink 30A. Then, the heat transmitted to the heat sink 30A will effectively be dissipated and released in the surrounding environment.

Figure 7:
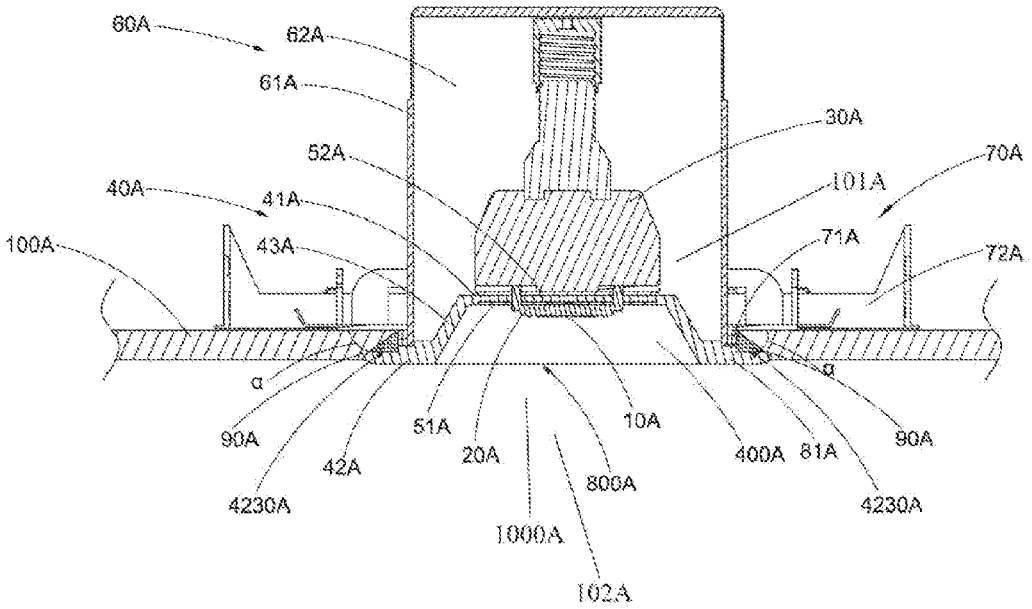
FIG. 7 is a sectional view of the recessed light apparatus according to the above second preferred embodiment of the present invention.

In particular, as shown in FIG. 7, a heat conducting channel 200A is formed between the light source unit 10A and the heat sink 30A, wherein the heat conducting portion 22A of the heat conductive element 20A is extended along the heat conducting channel 200A to contact with the heat sink 30A, so as to guide the heat to the heat sink 30.

It is worth mentioning that the base portion 21A and the heat conducting portion 22A of the heat conductive element 20A are made of high thermal conductivity material. Preferably, the thermal conductivity of the heat conductive element 20A should not be lesser than 10 W/m·K. The heat conductive element 20A is made of solid material having the thermal conductivity not lesser than 10 W/m·K for heat conduction. Preferably, heat conductive element 20A is made of solid material having the thermal conductivity not lesser than 300 W/m·K. For example, the heat conductive element 20A can be made of copper or copper alloy having the thermal conductivity not lesser than 300 W/m·K.

As shown in FIGS. 6 to 10, the recessed light apparatus of the present invention further comprises a thermal insulating member 40A provided between the heat sink 30A and the heat conductive element 20, wherein the ceiling 100A has an installing opening 1000A for installing the recessed light apparatus thereat. In particular, the thermal insulating member 40A is provided between the heat sink 30A and the base portion 21A of the heat conductive element 20A, wherein the heat conducting portion 22A of the heat conductive element 20A is extended through the thermal insulating member 40A to couple with the heat sink 30A, such that the thermal insulating member 40A is radially and outwardly extended from the heat conducting portion 22A of the heat conductive element 20A in a horizontal manner. In addition, the thermal insulating member 40A serves as an insulating panel extended to the ceiling 100A for not only separating the light source unit 10A from the ceiling 100A but also separating the heat sink 30 from the ceiling 100A. As a result, the thermal insulating member 40A not only prevents the heat from the light source unit 10A transmitting to the ceiling 100A but also prevents the heat from the heat sink 30A transmitting to the ceiling 100A, so as to prevent overheat of the ceiling 100A.

It is worth mentioning that the thermal insulating member 40A is made of low thermal conductivity material, such as gypsum, solid material containing magnesium, solid material containing magnesium chloride, glass beads, or other heat resistance materials. Accordingly, the thermal insulating member 40A is made of material having thermal conductivity lesser than 10 W/m·K. Preferably, the thermal insulating member 40A is made of material having thermal conductivity lesser than 1 W/m·K. For the best modification, the thermal insulating member 40A is made of material having thermal conductivity lesser than 0.1 W/m·K.

As shown in FIGS. 7 to 10, the recessed light apparatus of the present invention further comprises a first thermal expansion member 50A comprising a first thermal expansion element 51A provided between the heat conductive element 20A and the thermal insulating member 40A. In particular, the first thermal expansion element 51A is embedded in the thermal insulating member 40A and is located between the thermal insulating member 40A and the base portion 21A of the heat conductive element 20A, wherein the heat conducting portion 22A of the heat conductive element 20A is extended through the thermal insulating member 40A and the first thermal expansion element 51A to couple with the heat sink 30A, such that the first thermal expansion element 51A is radially and outwardly extended from the heat conducting portion 22A of the heat conductive element 20A in a horizontal manner. Accordingly, a width of the first thermal expansion element 51A is smaller than a width of the light base 11A of the light source unit 10A which is smaller than a width of the thermal insulating member 40A.

It is worth mentioning that the first thermal expansion element 51A is made of thermal expansion material, wherein the linear thermal expansion coefficient thereof must be smaller than 2 under 70° C. to 1000° C. When the light source unit 10A and the heat conductive element 20A are detached or melted at high temperature, the first thermal expansion element 51A will be self-expanded to block the heat conducting channel 200A so as to prevent the flame or fire spreading from the bottom side of the first thermal expansion element 51A through the heat conducting channel 200A to the upper side of the thermal insulating member 40A. In other words, the first thermal expansion element 51A can slow down the flame or fire being rapidly spread out to the upper space of the ceiling through the present invention.

Figure 6:
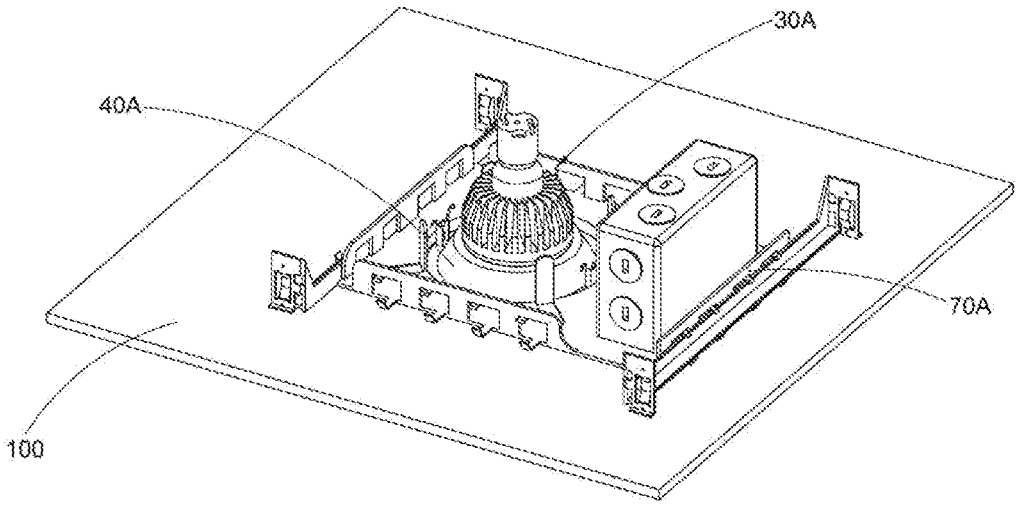
FIG. 6 is a perspective view of a recessed light apparatus according to a second preferred embodiment of the present invention.

As shown in FIGS. 6 and 7, the thermal insulating member 40A has an upper platform 41A provided between the heat sink 30A and the heat conductive element 20A, a lower platform 42A, and an inclined platform 43A extended from the upper platform 41A and the lower platform 42A, wherein the inclined platform 43A is outwardly and downwardly extended from the upper platform 41A and the lower platform 42A, such that the thermal insulating member 40A has a trapezoid cross section to define a light chamber 400A. Accordingly, the light source unit 10A is disposed at the light chamber 400A. It is worth mentioning that the lower platform 42A of the thermal insulating member 40A can be coupled at the ceiling 100A at the installing opening 1000A thereof. The upper platform 41A, the lower platform 42A, and the inclined platform 43A of the thermal insulating member 40A and the heat conducting portion 22A of the heat conductive element 20A form two isolated spaces within the light chamber 400A.

Furthermore, the first thermal expansion member 50A further comprises a second thermal expansion element 52A provided between the heat sink 30A and the thermal insulating member 40A and outwardly extended along the thermal insulating member 40A. In other words, the second thermal expansion element 52A is provide between the heat sink 30A and the thermal insulating member 40A and is outwardly extended from the heat conducting portion 22A of the heat conductive element 20A. When the light source unit 10A and the heat conductive element 20A are detached or melted at high temperature, the second thermal expansion element 52A will be self-expanded to block the heat conducting channel 200A so as to prevent the flame or fire spreading from the bottom side of the second thermal expansion element 52A through the heat conducting channel 200A to the upper side of the second thermal expansion element 52A. In other words, the second thermal expansion element 52A can slow down the flame or fire being rapidly spread out to the upper space of the ceiling through the present invention.

Figure 8:
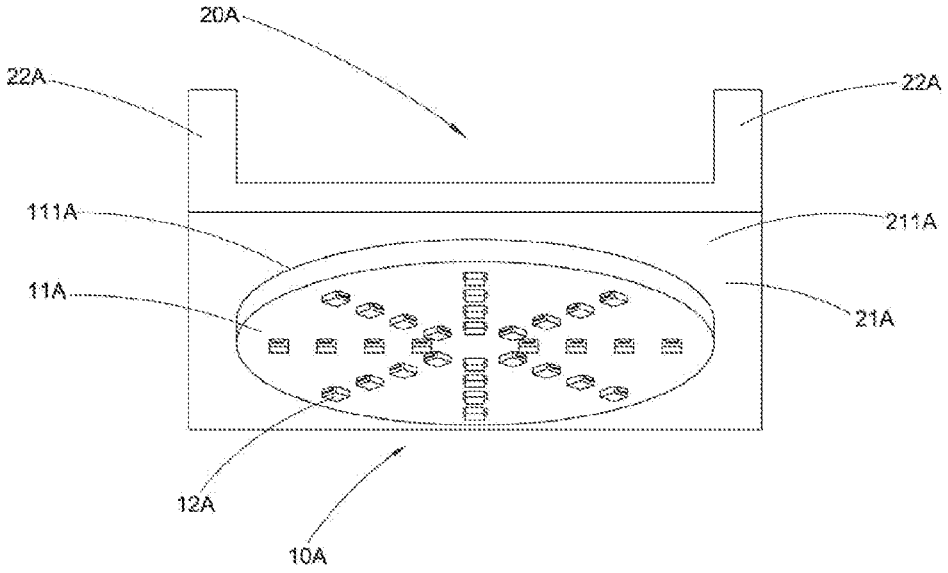
FIG. 8 is a perspective view of the recessed light apparatus according to the above second preferred embodiment of the present invention, illustrating heat being transmitted from the light emitting element to the heat conductive element.
Figure 9:
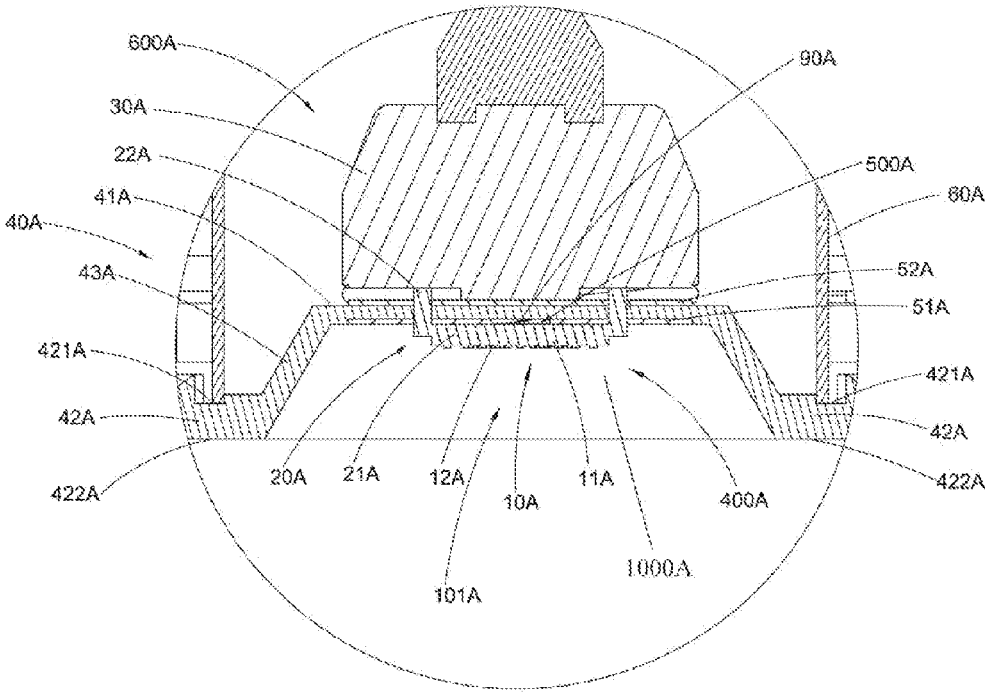
FIG. 9 is a sectional view of the thermal insulating member of the recessed light apparatus according to the above second preferred embodiment of the present invention, illustrating the thermal expansion element.

As shown in FIGS. 7 to 9, the recessed light apparatus of the present invention further comprises a resilient unit 90A provided between the thermal insulating member 40A and the base portion 21A of the heat conductive element 20A. Accordingly, the first thermal expansion element 51A forms a receiving chamber 500A between the thermal insulating member 40A and the base portion 21A of the heat conductive element 20A, wherein the resilient unit 90A is received at the receiving chamber 500A. In particular, the resilient unit 90A is normally in a compressed state that the resilient unit 90A is compressed to apply a downward resilient force against the heat conductive element 20A. When the heat conductive element 20A is damaged or melted at high temperature, the resilient unit 90A is uncompressed to apply the downward resilient force against the heat conductive element 20A to push the heat conductive element 20A in order to detach the heat conductive element 20A from the recessed light apparatus. Therefore, the detached heat conductive element 20A will prevent the contact with the heat sink 30A so as to prevent the flame or fire spreading to the heat sink 30A through the heat conductive element 20A. In other words, when the heat conducting portion 22A of the heat conductive element 20A is damaged or melted, the resilient unit 90A will push the heat conducting portion 22A of the heat conductive element 20A to detach from the heat conducting channel 200A. In addition, the first thermal expansion element 51A between the heat conductive element 20A and the thermal insulating member 40A and the second thermal expansion element 52A between the heat sink 30A and the thermal insulating member 40A will expand to block the heat conducting channel 200A so as to prevent the flame or fire spreading through the heat conducting channel 200A to the heat sink 30A.

Figure 10:
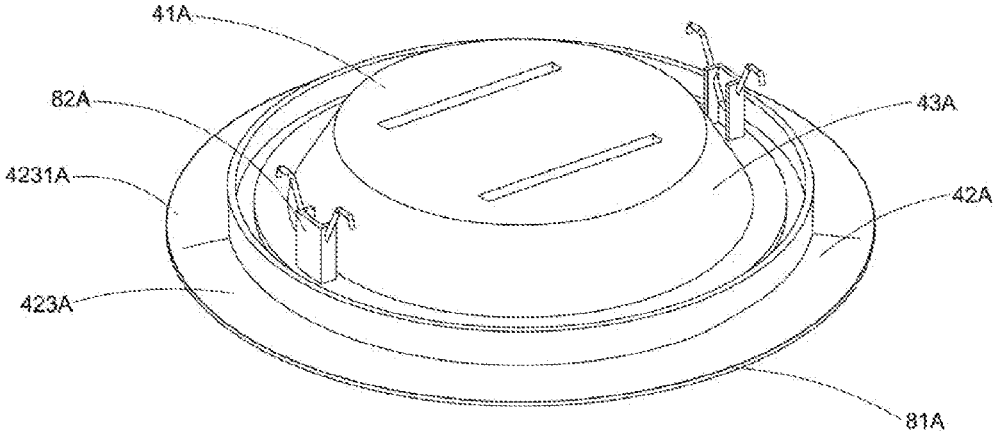
FIG. 10 is a perspective view of the thermal insulating member of the recessed light apparatus according to the above second preferred embodiment of the present invention.

As shown in FIGS. 6 and 10, the recessed light apparatus further comprises a light casing 60A. The lower platform 42A of the heat insulating member 40A is outwardly extended from the inclined platform 43A to the ceiling 100A. Accordingly, the light casing 60A is coupled at the lower platform 42A of the heat insulating member 40A. In addition, the lower platform 42A of the heat insulating member 40A has an upper platform surface 421A, a lower platform surface 422A, and a peripheral portion 423A, wherein the lower platform 42A of the heat insulating member 40A is extended to the outer wall surface 61A of the light casing 60A to separate the light casing 60A away from the ceiling 100A so as to prevent the overheat of the ceiling 100 during heat dissipation.

Accordingly, the light casing 60A further has the outer wall surface 61A and the inner wall surface 62A, wherein the inner wall surface 62A of the light casing 60A defines the receiving cavity 600A and does not contact with the heat sink 30A. In other words, the receiving cavity 600A of the light casing 60A provides a heat dissipating space for dissipating the heat from the heat sink 30A.

It is worth mentioning that the light casing 60A is also made of high thermal resistance material that the receiving cavity 600A of the light casing 60A serves as a fire-proof cavity for preventing the flame or fire spreading out from the upper side of the ceiling 100A. The melting point of the light casing 60A should not be lower than 1000° C.

As shown in FIGS. 6 and 10, the recessed light apparatus of the present invention further comprises a supporting frame 70A radially extended from the outer wall surface 61A of the light casing 60A to the ceiling 100A to support the light source unit 10A at the ceiling 100A. Accordingly, the supporting frame 70A comprises a supporting panel 71A radially and outwardly extended from the outer wall surface 61A of the light casing 60A towards the ceiling 100A, wherein the supporting panel 71A is made of high thermal conductivity solid material to dissipate the heat from the heat dissipating space of the light casing 60A to the surrounding environment. The thermal conductivity coefficient of the supporting panel 71A should not be lower than 20 W/m·K.

The supporting frame 70A further comprises a supporting member 72A upwardly extended from the supporting panel 71A and outwardly extended from the outer wall surface 61A of the light casing 60A, preferably extended in a horizontal manner, for coupling at a beam structure above the ceiling 100A, so as to retain the desired location of the supporting panel 71A at the ceiling 100A.

As shown in FIGS. 7 and 9, the thermal insulating member 40A is radially and outwardly extended from the heat conducting portion 22A of the heat conductive element 20A in a horizontal manner for separating the heat sink 30A from the ceiling 100A. In particular, the peripheral portion 423A of the lower platform 42A of the heat insulating member 40A forms a peripheral surface 4231A for coupling with the ceiling 100A. In other words, the peripheral surface 4231A of the thermal insulating member 40A will increase the contact surface area to the ceiling 100A to secure the thermal insulating member 40A at the ceiling 100A. In addition, the opening rim of the ceiling 100A has an inclined surface to define an angle α with respect to the peripheral surface 4231A of the thermal insulating member 40A. The angle α can be an acute angle or an obtuse angle. The angle α is preferred to be configured either smaller than 60° or larger than 150°. Preferably, the angle α is smaller than 60°.

As shown in FIGS. 7 and 10, the recessed light apparatus of the present invention further comprises a second thermal expansion member 90A, wherein the thermal insulating member 40A has a peripheral cavity 4230A formed at the peripheral portion 423A and above the peripheral surface 4231A. In particular, the peripheral cavity 4230A is indented at the peripheral portion 423A, such that the peripheral cavity 4230A is formed at the peripheral portion 423A of the lower platform 42A of the thermal insulating member 40A. The second thermal expansion member 90A is received at the peripheral cavity 4230A to encircle around the peripheral portion 423A of the thermal insulating member 40A. Therefore, when the lower platform 42A of the thermal insulating member 40A is coupled at the ceiling 100A, the second thermal expansion member 90A is located between the ceiling 100A and the lower platform 42A of the peripheral surface 4231A of the thermal insulating member 40A. During the thermal expansion of the second thermal expansion member 90A, the expanded second thermal expansion member 90A will fill up the clearance between the lower platform 42A of the thermal insulating member 40A and the ceiling 100A to block the flame or fire to pass through the clearance between the peripheral portion 423A of the lower platform 42A of the thermal insulating member 40A and the ceiling 100A.

It is worth mentioning that when the angle α is larger than 90°, the ceiling 100A will serve as a support of the recessed light apparatus to support and retain the recessed light apparatus in position.

As shown in FIG. 8, the base portion 21A of the heat conductive element 20A is upwardly extended from the light base 11A of the light source unit 10A, wherein the light base 11A of the light source unit 10A has an upper base surface 111A thermally contacting with a bottom base surface 211A of the base portion 21A of the heat conductive element 20A. In particular, a surface area of the bottom base surface 211A of the base portion 21A of the heat conductive element 20A is larger than a surface area of the upper base surface 111A of the light base 11A of the light source unit 10A. Therefore, the heat generated from the light emitting element 12A at the light base 11A can be effectively transmitted to the heat sink 30A through the heat conductive element 20A.

Accordingly, two or more heat conducting portions 22A of the heat conductive element 20A are spacedly extended from the base portion 21A thereof, wherein each heat conducting portion 22A of the heat conductive element 20A has a planar structure to increase a surface area thereof to effectively transmit the heat to the heat sink 30A. In particular, the heat conducting portions 22A of the heat conductive element 20A are spacedly extended from two side end portions of the base portion 21A thereof respectively to the heat sink 30A. In addition, two heat conducting channels are formed to allow the two heat conducting portions 22A of the heat conductive element 20A to extend through the heat conducting channels to the heat sink 30A.

As shown in FIG. 10, the recessed light apparatus further comprises a face cover 80A provided under the thermal insulating member 40A, wherein the face cover 80A has a cover opening 800A, wherein the light from the light source unit 1 OA will pass through the cover opening 800A to the area below the ceiling 100A for illumination.

In particular, the face cover 80A comprises a cover panel 81A and a cover connector 82A upwardly extended from the cover panel 81A, wherein the light casing 60A further comprises a coupler 63A provided at the inner wall surface 62A. Accordingly, the cover connector 82A is upwardly extended from a peripheral edge of the cover panel 81A to detachably couple the coupler 63A of the light casing 60A, so as to detachably secure the face cover 80A.

Figure 11:
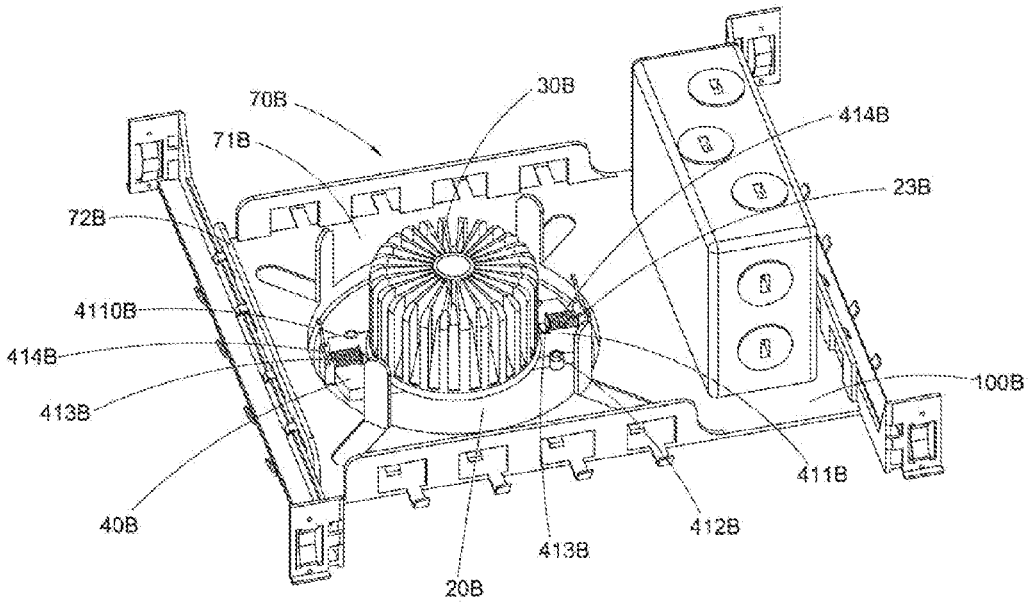
FIG. 11 is a perspective view of a recessed light apparatus according to a third preferred embodiment of the present invention.
Figure 12:
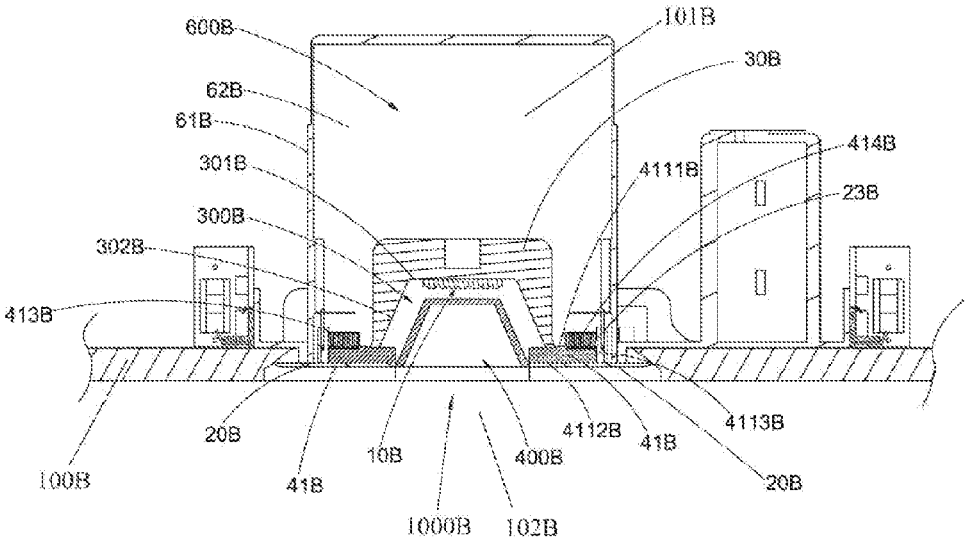
FIG. 12 is a sectional view of the recessed light apparatus according to the above third preferred embodiment of the present invention.

As shown in FIGS. 11 and 12, a recessed light apparatus according to a third embodiment illustrates an alternative mode of the first embodiment, wherein the recessed light apparatus comprises a light source unit 10B, at least a thermal insulating member 20B, and at least a heat sink 30B. The light source unit 10B is coupled to the heat sink 30A and is arranged for electrically connected to an external power source for operation. Accordingly, the light source unit 10B comprises at least a light emitting element 11B, wherein when the light source unit 10B is electrified via the external power source, the light emitting element 11B will emit light energy. The heat generated by the light source unit 10B will transmit to the heat sink 30B, wherein the heat sink 30B will dissipate the heat to prevent the overheat of the light source unit 10B and to prolong the service life span thereof. It is worth mentioning that the heat sink 30B serves as the heat conductive element to transmit the heat from the light source unit 10B, such that the heat sink 30B and the heat conductive element are integrated as one single heat conductive member. The thermal insulating member 20B is located under the heat sink 30B and is outwardly extended to the ceiling 100B to prevent the heat from the light source unit 10B being transmitted to the ceiling 100B so as to prevent the overheat of the ceiling 100B. In particular, the light emitting element 11B of the light source unit 10B can be directly coupled at the heat sink 30B. The ceiling 100B has an installing opening 1000B for the recessed light apparatus to be installed thereat.

It is worth mentioning that the light emitting element 11B should not be limited as a thermal radiation and light emission source, such as an incandescent light emitting element, halogen light emitting element, glass reflective light emitting element, or energy saving light emitting element, gas discharging light source, such as fluorescent light emitting element or sodium, mercury and metal halide light emitting element, solid state light source, such as light emitting diode (LED) or organic light emitting diode (OLED), or other forms of light emitting element. Preferably, the light emitting element 11B of the present invention is light emitting diode (LED).

The heat sink 30B has a heat dissipating portion 31B and a bottom portion 32B downwardly extended therefrom. The heat sink 30B further has a light chamber 300B and a bottom opening formed at the bottom portion 32B to communicate with the light chamber 300B. The heat sink 30B further has a light ceiling wall 301B defined at a top side of the light chamber 300B and a light surrounding wall 302B downwardly extended from the light ceiling wall 301B to define the light chamber 300B within the light ceiling wall 301B and the light surrounding wall 302B. The light source unit 10B is disposed within the light chamber 300B and is supported at the light ceiling wall 301B for projecting the light downward to the bottom opening. In other words, the light source unit 10B is contacted with the light ceiling wall 301B of the heat sink 30B, such that when the light source unit 10B generates heat, the heat can be effectively transmitted to the heat sink 30B for heat dissipation. Accordingly, the thermal insulating member 20B is provided at the bottom portion 32B of the heat sink 30B to define an upper space 101B above the thermal insulating member 20B and a bottom space 102B below the thermal insulating member 20B. Therefore, the thermal insulating member 20B can effectively prevent the flame or fire spreading from the bottom space 102B to the upper space 101B.

It is worth mentioning that the thermal insulating member 20B is made of low thermal conductivity material, such as gypsum. Accordingly, the thermal insulating member 20B is made of material having thermal conductivity lesser than 10 W/m·K. Preferably, the thermal insulating member 20B is made of material having thermal conductivity lesser than 1 W/m·K. For the best modification, the thermal insulating member 20B is made of material having thermal conductivity lesser than 0.1 W/m·K.

As shown in FIGS. 11 and 12, the recessed light apparatus of the present invention further comprises a first thermal expansion member 40B comprising two thermal expansion elements 41B spacedly provided between the thermal insulating member 20B and the heat sink 30B to form a light channel 400B between the thermal expansion elements 41B. The light channel 400B is aligned with the bottom opening of the heat sink 30B for allowing the light passing through. It is worth mentioning that the two thermal expansion elements 41B can be integrated as one single thermal expansion element having an annular shape, such that the light channel 400B is formed at a center of the single thermal expansion element.

As shown in FIGS. 11 and 12, each thermal expansion element 41B comprises an elongated expansion body 411B and a retainer 412B coupled at the expansion body 411B to retain the expansion body 411B in position to form the light channel 400B between the two expansion bodies 411B. In particular, each expansion body 411B has a retainer slot 4110B, wherein the retainer 412B is upwardly extended from the thermal insulating member 20B to insert into the retainer slot 4110B so as to retain the expansion body 411B on the thermal insulating member 20B at a desired position. In particular, the expansion bodies 411B are spacedly aligned end-to-end to form the light channel 400B between two inner ends of the expansion bodies 411B and are radially extended from the heat sink 30B. Therefore, when the expansion bodies 411B are retained by the retainers 412B on the thermal insulating member 20B, the light channel 400B is formed between two inner ends of the expansion bodies 411B.

As shown in FIG. 12, each thermal expansion element 41B further comprises a holder 413B. Each expansion body 411B has an upper expansion surface 4111B, a bottom expansion surface 4112B, and an outer peripheral expansion surface 4113B. The holder 413B is upwardly extended from the upper expansion surface 4111B of the expansion body 411B. The thermal insulating member 20B comprises two spaced apart second holders 23B extended upwardly from a peripheral edge portion of the thermal insulating member 20B, wherein the second holders 23B are extended at two outer ends of the expansion bodies 411B to align with the holders 413B respectively. Each thermal expansion element 41B further comprises two resilient elements 414B, wherein each of the resilient elements 414B has two ends coupled at the holder 413B and the second holder 23B respectively. Accordingly, the resilient elements 414B are two compression springs which are normally held in a compressed form. In particular, the resilient elements 414B are held above the upper expansion surfaces 4111B of the expansion bodies 411B and are radially extended with respect to the heat sink 30B. Each of the resilient elements 414B normally applies an inward pushing force at a radial direction of the heat sink 30B. In other words, the holders 413B are pushed by the resilient elements 414B to push the expansion bodies 411B towards the heat sink 30B at the radial direction thereof. On the other hand, the retainers 412B will retain the expansion bodies 411B to withstand the pushing forces of the resilient elements 414B so as to prevent the expansion bodies 411B being pushed towards the heat sink 30B. Accordingly, when the retainers 412B are damaged or melted, the resilient elements 41B will push the expansion bodies 411B towards each other to close the light channel 400B of the first thermal expansion member 40B. In other words, in case of fire, the retainers 412B will be damaged by the fire, such that the compressed resilient elements 41B will be returned to the original form to push the expansion bodies 411B. As a result, the expansion bodies 411B will shift and move towards each other to close the light channel 400B, so as to prevent the flame or fire spreading from the bottom side of the first thermal expansion member 40B through the light channel 400B to the upper side of the first thermal expansion member 40B.

It is worth mentioning that the expansion body 411B is made of thermal expansion material, wherein the linear thermal expansion coefficient thereof must be smaller than 2 under 70° C. to 1000° C. At high temperature, the expansion bodies 411B of the thermal expansion element 41B will be self-expanded as well to block the light channel 400B so as to prevent the flame or fire spreading from the bottom side of the first thermal expansion member 40B through the heat conducting channel 200A to the upper side of the first thermal expansion member 40B. In other words, the first thermal expansion member 40B can slow down the flame or fire being rapidly spread out to the upper space of the ceiling through the present invention.

It is worth mentioning that each of the retainers 412B is made of solid material having low melting point. At high temperature, the retainers 412B will be damaged or melted to enable the expansion bodies 411B being pushed by the resilient elements 41B towards each other to close the light channel 400B of the first thermal expansion member 40B. Accordingly, the melting point of the retainer 412B should not be higher than 1000° C. Preferably, the melting point of the retainer 412B should be configured between 80° C. and 300° C.

As shown in FIGS. 11 and 12, the recessed light apparatus further comprises a light casing 60B upwardly extended from the thermal insulating member 20B, wherein the thermal insulating member 20B separates the light casing 60B from the ceiling 100B.

Accordingly, the light casing 60B has a bottom opening and a receiving cavity 600B to receive the heat sink 30B therein. In particular, the light casing 60B further has an outer wall surface 61B and an inner wall surface 62B, wherein the inner wall surface 62B of the light casing 60B defines the receiving cavity 600B and does not contact with the heat sink 30B. In other words, the receiving cavity 600B of the light casing 60B provides a heat dissipating space for dissipating the heat from the heat sink 30B.

It is worth mentioning that the light casing 60B is also made of high thermal resistance material that the receiving cavity 600B of the light casing 60B serves as a fire-proof cavity for preventing the flame or fire spreading out from the upper side of the ceiling 100B. The melting point of the light casing 60B should not be lower than 1000° C.

As shown in FIGS. 11 and 12, the recessed light apparatus of the present invention further comprises a supporting frame 70B radially extended from the outer wall surface 61B of the light casing 60B to the ceiling 100B to support the light source unit 10B at the ceiling 100B. Accordingly, the supporting frame 70B comprises a supporting panel 71B radially and outwardly extended from the outer wall surface 61B of the light casing 60B towards the ceiling 100B, wherein the supporting panel 71B is made of high thermal conductivity solid material to dissipate the heat from the heat dissipating space of the light casing 60B to the surrounding environment.

The supporting frame 70B further comprises a supporting member 72B extended from the supporting panel 71B for coupling at a beam structure above the ceiling 100B, so as to retain the desired location of the supporting panel 71B at the ceiling 100B.

As shown in FIGS. 11 and 12, the thermal insulating member 20B is radially and outwardly extended from the heat sink 30B in a horizontal manner for separating the heat sink 30B from the ceiling 100B. The thermal insulating member 20B has a peripheral portion 21B. In particular, the peripheral portion 21B of the thermal insulating member 20B forms a peripheral surface 211B for coupling with the ceiling 100B. In other words, the peripheral surface 211B of the thermal insulating member 20B will increase the contact surface area to the ceiling 100B to secure the thermal insulating member 20B at the ceiling 100B. In addition, the opening rim of the ceiling 100B has an inclined surface to define an angle $\alpha$ with respect to the peripheral surface 211B of the thermal insulating member 20B. The angle $\alpha$ can be an acute angle or an obtuse angle. The angle $\alpha$ is preferred to be configured either smaller than 60° or larger than 150°. Preferably, the angle $\alpha$ is smaller than 60°.

It is worth mentioning that when the angle $\alpha$ is larger than 90°, the ceiling 100B will serve as a support of the recessed light apparatus to support and retain the recessed light apparatus in position.

As shown in FIGS. 13 to 17, a recessed light apparatus according to a fourth embodiment illustrates an alternative mode of the first embodiment, wherein the recessed light apparatus comprises a light source unit 10C, at least a heat sink 30C and at least a thermal insulating member 40C. The heat sink 30C has a bottom portion 31C and a heat dissipating portion 32C upwardly extended therefrom. It is worth mentioning that the heat sink 30C serves as the heat conductive element to transmit the heat from the light source unit 10C, such that the heat sink 30C and the heat conductive element are integrated as one single heat conductive member. The light source unit 10B is coupled to the bottom portion 31C of the heat sink 30C and is arranged for electrically connected to an external power source for operation. Accordingly, the thermal insulating member 40C is provided at the bottom portion 31C of the heat sink 30C to define an upper space 101C above the thermal insulating member 40C and a bottom space 102C below the thermal insulating member 40C. Therefore, the thermal insulating member 40C can effectively prevent the flame or fire spreading from the bottom space 102C to the upper space 101C. Accordingly, the thermal insulating member 40C is downwardly and outwardly extended from the bottom portion 31C of the heat sink 30C to support the heat sink 30C above the ceiling, such that the thermal insulating member 40C generally has a conical shape. Accordingly, the light source unit 10C comprises at least a light emitting element 11C, wherein when the light source unit 10C is electrified via the external power source, the light emitting element 11C will emit light energy.

It is worth mentioning that the light emitting element 11C should not be limited as a thermal radiation and light emission source, such as an incandescent light emitting element, halogen light emitting element, glass reflective light emitting element, or energy saving light emitting element, gas discharging light source, such as fluorescent light emitting element or sodium, mercury and metal halide light emitting element, solid state light source, such as light emitting diode (LED) or organic light emitting diode (OLED), or other forms of light emitting element. Preferably, the light emitting element 11C of the present invention is light emitting diode (LED).

Figure 14:
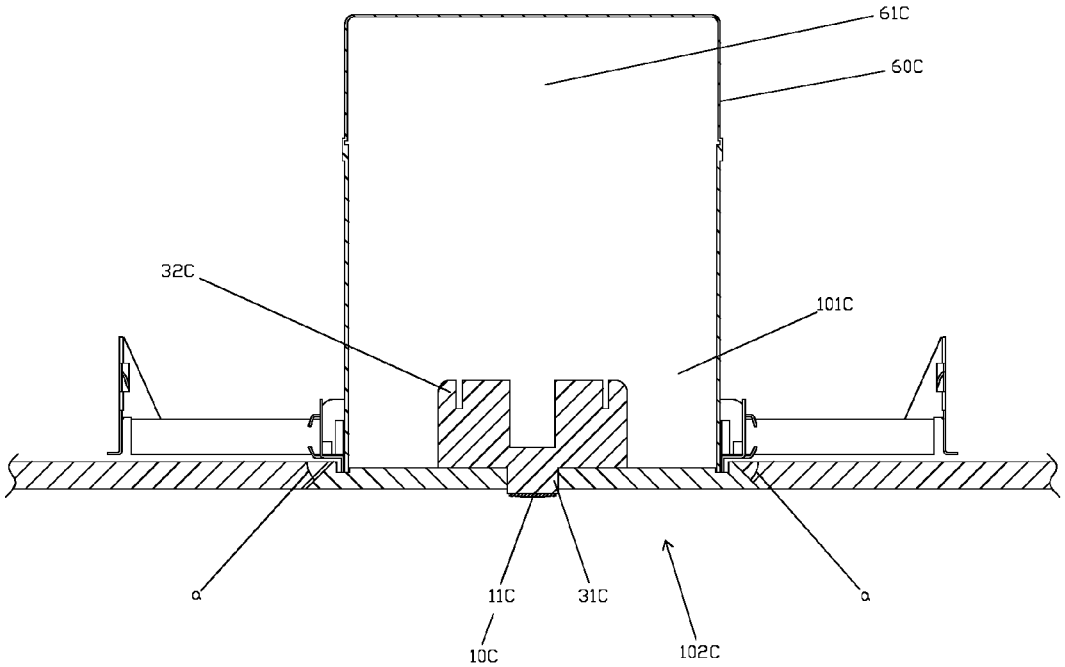
FIG. 14 is a sectional view of the recessed light apparatus according to the above fourth preferred embodiment of the present invention.
Figure 16:
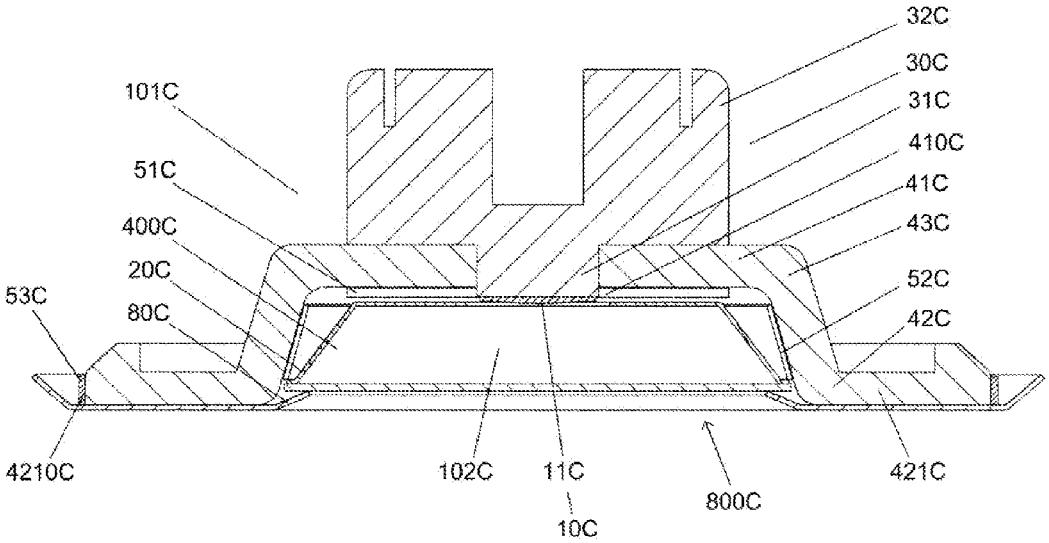
FIG. 16 is a sectional view of the recessed light apparatus according to the above fourth preferred embodiment of the present invention, illustrating the conical shape of the thermal insulating member.

As shown in FIGS. 14 and 16, the thermal insulating member 40C has an upper platform 41C provided at the bottom portion 31C of the heat sink 30C, a lower platform 42C, and an inclined platform 43C extended from the upper platform 41C and the lower platform 42C, wherein the inclined platform 43C is outwardly and downwardly extended from the upper platform 41C and the lower platform 42C, such that the thermal insulating member 40C has a trapezoid cross section to define a light chamber 400C. In other words, the light chamber 400C is formed at the bottom space 102C below the thermal insulating member 40C. In particular, the upper platform 41C of the thermal insulating member 40C is horizontally extended at the bottom portion 31C of the heat sink 30C. The inclined platform 43C is downwardly and outwardly extended from the upper platform 41C and the lower platform 42C. The lower platform 42C is radially extended from the inclined platform 43C to parallel with the upper platform 41C. Therefore, the heat sink 30C is supported above and separated from the ceiling by the thermal insulating member 40C.

As shown in FIGS. 14 and 16, the thermal insulating member 40C further has a first through channel 410C formed at the upper platform 41C, preferably at the center thereof. Accordingly, the bottom portion 31C of the heat sink 30C is extended through the first through channel 410C into the light chamber 400C, wherein the first through channel 410C is formed at the upper platform 41C at a position between the bottom portion 31C of the heat sink 30C and the light chamber 400C, such that the light source unit 10C at the bottom side of the bottom portion 31C of the heat sink 30C is supported within the light chamber 400C for generating the light therewithin. Preferably, a cross section of the first through channel 410C is gradually increased from top to bottom, such that the light from the light source unit 10C can pass through the first through channel 410C into the light chamber 400C. It is preferred that the length of the bottom portion 31C of the heat sink 30C is long enough to extend through the first through channel 410C into the light chamber 400C.

As shown in FIGS. 14 and 16, the lower platform 42C of the thermal insulating member 40C has a peripheral portion 421C. In particular, the peripheral portion 421C of the thermal insulating member 40C forms a peripheral surface 4211C for coupling with the ceiling. In other words, the peripheral surface 4211C of the thermal insulating member 40C will increase the contact surface area to the ceiling to secure the thermal insulating member 40C at the ceiling. In addition, the peripheral surface 4211C of the thermal insulating member 40C has an inclined surface to define an angle $\alpha$ with respect to the ceiling. The angle $\alpha$ should be an acute angle. Preferably, the angle $\alpha$ is smaller than 60°.

It is worth mentioning that when the angle $\alpha$ is smaller than 60°, the ceiling will serve as a support of the recessed light apparatus to support and retain the recessed light apparatus in position. In particular, the peripheral surface 4211C of the peripheral portion 421C of the thermal insulating member 40C is biased against the opening rim of the installing opening of the ceiling to keep the aesthetic appearance of the ceiling with the recessed light apparatus thereat.

Figure 15:
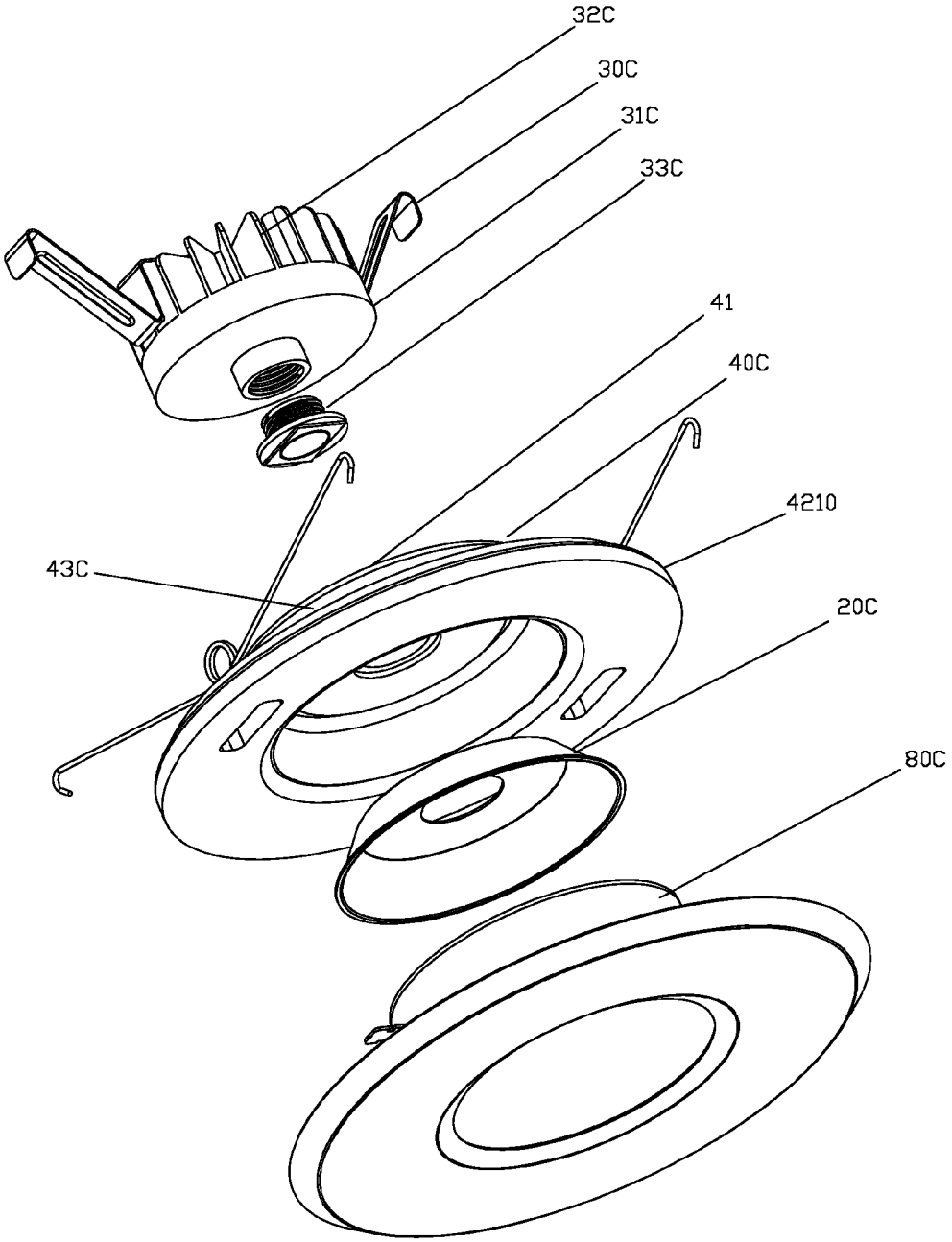
FIG. 15 is an exploded perspective view of the recessed light apparatus according to the above fourth preferred embodiment of the present invention.

As shown in FIGS. 14 to 16, the recessed light apparatus further comprises a light adjustor 20C disposed in the light chamber 400C, wherein the light adjustor 20C has a light entrance 201C aligned with the first through channel 410C and a light exit 202C aligned with the light entrance 201C for allowing the light to pass through the light entrance 201C to the light exit 202C. The light adjustor 20C is arranged to adjust the light within the light chamber 400C being reflected by the inclined platform 43C to ensure the light reflected by the inclined platform 43C to project downwardly from the light chamber 400C. Accordingly, the light adjustor 20C has a trapezoid cross section. As shown in FIG. 14, the light adjustor 20C has a conical shape.

As shown in FIGS. 14 to 16, the recessed light apparatus of the present invention further comprises a first thermal expansion member 50C comprising a first thermal expansion element 51C provided between the light adjustor 20C and the upper platform 41C of the thermal insulating member 40C. In particular, the light adjustor 20C has a top end portion 21C, wherein the width of the first thermal expansion element 51C is larger than the width of the top end portion 21C of the light adjustor 20C. Therefore, when the first thermal expansion element 51C is self-expanded at high temperature, the first through channel 410C is blocked by the first thermal expansion element 51C so as to prevent the flame or fire spreading through the first through channel 410C and to prevent the flame or fire directly burning the upper platform 41C of the thermal insulating member 40C, thereby preventing the flame or fire spreading above the ceiling.

As shown in FIGS. 14 to 16, the first thermal expansion member 50C further comprises a second thermal expansion element 52C provided between the light adjustor 20C and the inclined platform 43C of the thermal insulating member 40C. In particular, the second thermal expansion element 52C is extended along the inclined platform 43C of the thermal insulating member 40C. When the second thermal expansion element 52C is self-expanded at high temperature, the second thermal expansion element 52C will block the flame or fire directly burning to the inclined platform 43C of the thermal insulating member 40C, so as to prevent the flame or fire spreading above the ceiling.

As shown in FIG. 16, the first thermal expansion member 50C comprising a third thermal expansion element 53C provided at a peripheral surface 4210C of the peripheral portion 421C of the heat insulating member 40C which is coupled at the ceiling. When the third thermal expansion element 53C is self-expanded at high temperature, the third thermal expansion element 53C will fill up the clearance between the peripheral surface 4210C of the peripheral portion 421C of the heat insulating member 40C and the ceiling for preventing the flame or fire spreading above the ceiling through the clearance.

It is worth mentioning that the first thermal expansion element 51C is made of thermal expansion material, wherein the linear thermal expansion coefficient thereof must be smaller than 2 under 70° C. to 1000° C. Accordingly, the high temperature as mentioned above refers to 120° C. or above. The second thermal expansion element 52C is made of thermal expansion material, wherein the linear thermal expansion coefficient thereof must be smaller than 2 under 70° C. to 1000° C. The third thermal expansion element 53C is made of thermal expansion material, wherein the linear thermal expansion coefficient thereof must be smaller than 2 under 70° C. to 1000° C.

As shown in FIGS. 14 and 16, the recessed light apparatus further comprises a light casing 60C upwardly extended from the lower platform 42C of the thermal insulating member 40C, wherein the lower platform 42C of the thermal insulating member 40C separates the light casing 60C from the ceiling. In particular, the light casing 60C further has an outer wall surface 61C and an inner wall surface 62C, wherein the lower platform 42C of the thermal insulating member 40C is radially and outwardly extended from the outer wall surface 61C of the light casing 60C to separate the light casing 60C from the ceiling.

As shown in FIGS. 14 and 16, the light casing 60C has a bottom opening and a receiving cavity 600C to receive the heat sink 30C therein, wherein the receiving cavity 600C is defined within the inner wall surface 62C. Accordingly, the inner wall surface 62C of the light casing 60C defines the receiving cavity 600C and does not contact with the heat sink 30C. In other words, the receiving cavity 600C of the light casing 60C provides a heat dissipating space for dissipating the heat from the heat sink 30C.

It is worth mentioning that the light casing 60C is also made of high thermal resistance material that the receiving cavity 600C of the light casing 60C serves as a fire-proof cavity for preventing the flame or fire spreading out from the lower space 102C to the upper side of the ceiling through the receiving cavity 600C. The melting point of the light casing 60C should not be lower than 1000° C.

As shown in FIG. 14, the light casing 60C further comprises a coupler 63C provided at the inner wall surface 62C and extended to the heat sink 30C so as to retain the heat sink 30C within the receiving cavity 600C.

Figure 13:
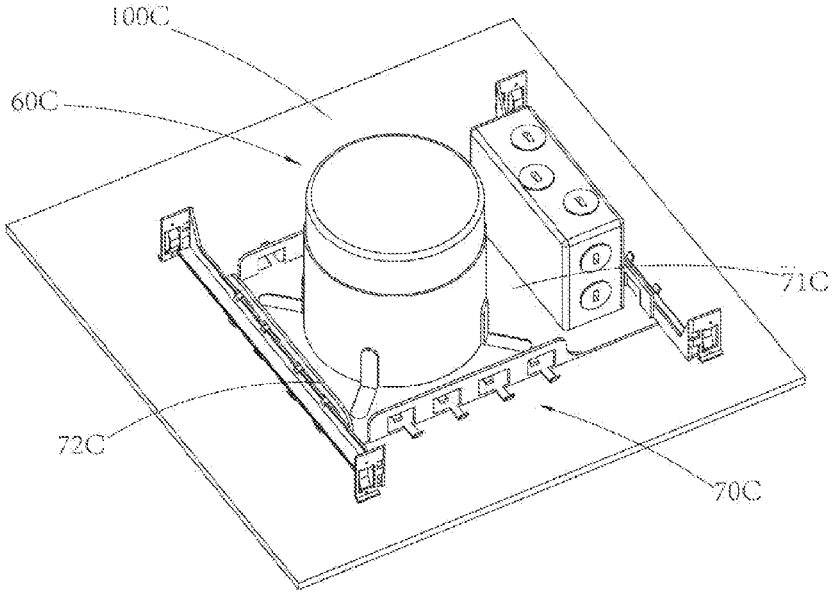
FIG. 13 is a perspective view of a recessed light apparatus according to a fourth preferred embodiment of the present invention.

As shown in FIG. 13, the recessed light apparatus of the present invention further comprises a supporting frame 70C radially extended from the outer wall surface 61C of the light casing 60C to the ceiling to support the light source unit 10C at the ceiling. Accordingly, the supporting frame 70C comprises a supporting panel 71C radially and outwardly extended from the outer wall surface 61C of the light casing 60C towards the ceiling, wherein the supporting panel 71C is made of high thermal conductivity solid material to dissipate the heat from the heat dissipating space of the light casing 60A to the surrounding environment. The thermal conductivity coefficient of the supporting panel 71A should not be lower than 20 W/m·K.

The supporting frame 70C further comprises a supporting member 72C upwardly extended from the supporting panel 71C and outwardly extended from the outer wall surface 61C of the light casing 60C, preferably extended in a horizontal manner, for coupling at a beam structure above the ceiling, so as to retain the desired location of the supporting panel 71C at the ceiling.

As shown in FIGS. 14 to 16, the recessed light apparatus further comprises a face cover 80C provided under the thermal insulating member 40C, wherein the face cover 80C has a cover opening 800C, wherein the light from the light source unit 10A will pass through the cover opening 800C to the area below the ceiling 100A for illumination.

Figure 17:
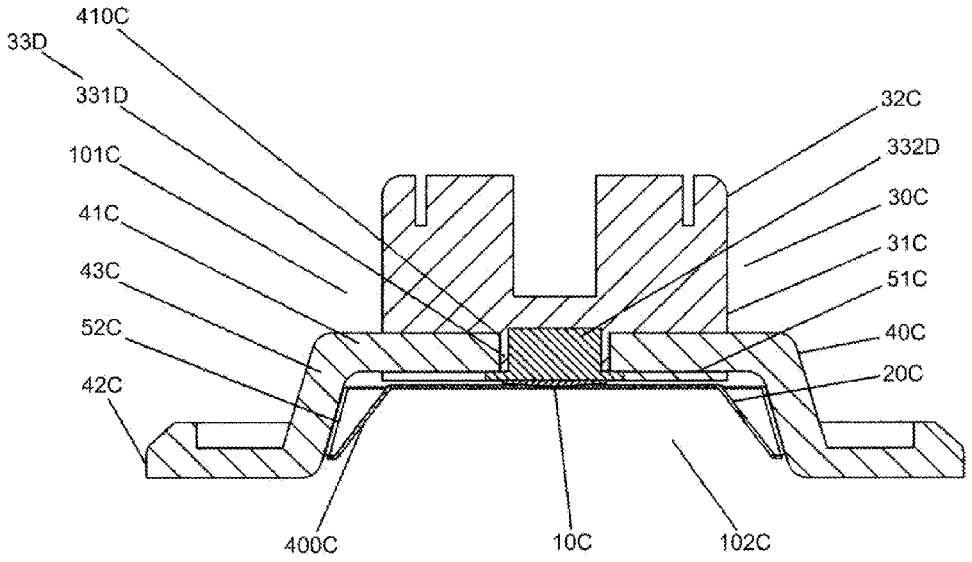
FIG. 17 illustrates an alternative mode of the heat sink of the recessed light apparatus according to the above fourth preferred embodiment of the present invention.

FIG. 17 illustrates a recessed light apparatus as a modification of the fourth embodiment, wherein the recessed light apparatus comprises a light source unit 10C, at least a heat sink 30C and at least a thermal insulating member 40C. The heat sink 30C has a bottom portion 31C, a heat dissipating portion 32C upwardly extended from the bottom portion 31C, and an extension portion 33D downwardly extended from the bottom portion 31C. It is worth mentioning that the heat sink 30C serves as the heat conductive element to transmit the heat from the light source unit 10C, such that the heat sink 30C and the heat conductive element are integrated as one single heat conductive member. The light source unit 10B is coupled to the extension portion 33D of the heat sink 30C and is arranged for electrically connected to an external power source for operation. Accordingly, the thermal insulating member 40C is provided at the bottom portion 31C of the heat sink 30C to define an upper space 101C above the thermal insulating member 40C and a bottom space 102C below the thermal insulating member 40C. Therefore, the thermal insulating member 40C can effectively prevent the flame or fire spreading from the bottom space 102C to the upper space 101C. Accordingly, the thermal insulating member 40C is downwardly and outwardly extended from the bottom portion 31C of the heat sink 30C to support the heat sink 30C above the ceiling, such that the thermal insulating member 40C generally has a conical shape. Accordingly, the light source unit 10C comprises at least a light emitting element 11C, wherein when the light source unit 10C is electrified via the external power source, the light emitting element 11C will emit light energy.

As shown in FIG. 17, the thermal insulating member 40C has an upper platform 41C provided at the bottom portion 31C of the heat sink 30C, a lower platform 42C, and an inclined platform 43C extended from the upper platform 41C and the lower platform 42C, wherein the inclined platform 43C is outwardly and downwardly extended from the upper platform 41C and the lower platform 42C, such that the thermal insulating member 40C has a trapezoid cross section to define a light chamber 400C.

As shown in FIG. 17, the thermal insulating member 40C further has a first through channel 410C formed at the upper platform 41C, preferably at the center thereof, and located between the bottom portion 31C of the heat sink 30C and the light chamber 400C. Accordingly, the extension portion 33D of the heat sink 30C is extended through the first through channel 410C into the light chamber 400C, such that the light source unit 10C at the extension portion 33D of the heat sink 30C is supported within the light chamber 400C for generating the light therewithin. Preferably, a cross section of the first through channel 410C is gradually increased from top to bottom, such that the light from the light source unit 10C can pass through the first through channel 410C into the light chamber 400C. It is preferred that the length of the extension portion 33D of the heat sink 30C is long enough to extend through the first through channel 410C into the light chamber 400C. Accordingly, the extension portion 33D of the heat sink 30C has a heat conducting slot 331D indently from the bottom portion 31C of the heat sink 30C and an installing portion 332D extended upwardly to engage with the heat conducting slot 331D, wherein the light source unit 10C is coupled at the installing portion 332D. Accordingly, the heat conducting slot 331D has an inner threaded structure and the installing portion 332D has an outer threaded structure, such that the installing portion 332D is rotatably and detachably coupled at the heat conducting slot 331D so as to detachably couple the extension portion 33D of the heat sink 30C with the bottom portion 31C thereof. Therefore, the heat from the light source unit 10C can be effectively transmitted through the engagement between the heat conducting slot 331D and the installing portion 332D to the heat sink 30C. In other words, the installing portion 332D is tightly contacted within the heat conducting slot 331D for ensuring the heat transmission so as to effectively transmit the light source unit 10C to the heat dissipating portion 32C of the heat sink 30C.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A recessed light apparatus for installing into a ceiling, comprising:

a light source unit for generating light;

a heat sink supported above said light source for dissipating heat from said light source unit;

a thermal insulating member provided below said heat sink, wherein a peripheral portion of said thermal insulating member is outwardly extended for coupling at the ceiling, such that said thermal insulating member forms an insulation partition for preventing fire spreading above said thermal insulating member in case of fire, wherein said thermal insulating member has an upper platform extended underneath said heat sink, a lower platform, and an inclined platform outwardly and downwardly extended from said upper platform to said lower platform to define a light chamber within said upper platform, said lower platform, and said inclined platform, wherein said light source unit is disposed at said light chamber, wherein said thermal insulating member further has a first through channel formed at said upper platform to communicate with said light chamber, wherein said heat sink has a bottom portion extended through said first through channel, wherein said light source unit is provided at said bottom portion of said heat sink; and a light adjustor disposed in said light chamber, wherein said light adjustor has a light entrance aligned with said first through channel and a light exit aligned with said light entrance for allowing the light to pass through said light entrance to said light exit, wherein said light adjustor is arranged to adjust the light within said light chamber being reflected by said inclined platform to ensure the light reflected by said inclined platform to project downwardly from said light chamber.

2. The recessed light apparatus, as recited in claim 1, further comprising a first thermal expansion element provided between said light adjustor and said upper platform of said thermal insulating member, wherein said first thermal expansion element is self-expanded, in response to temperature, to block said first through channel.

3. The recessed light apparatus, as recited in claim 2, further comprising a second thermal expansion element provided between said light adjustor and said inclined platform of said thermal insulating member, wherein said second thermal expansion element is extended along said inclined platform of said thermal insulating member, wherein said second thermal expansion element is self-expanded, in response to temperature, to block the fire directly burning to said inclined platform of said thermal insulating member.

4. The recessed light apparatus, as recited in claim 3, further comprising a third thermal expansion element provided at said peripheral portion of said heat insulating member, wherein said third thermal expansion element is self-expanded, in response to temperature, to fill up a clearance between said peripheral portion of said heat insulating member and the ceiling for preventing the fire spreading above the ceiling through said clearance.

5. The recessed light apparatus, as recited in claim 4, further comprising a light casing upwardly extended from said lower platform of said thermal insulating member, wherein said light casing has a receiving cavity to receive said heat sink therein, wherein said lower platform of said thermal insulating member is outwardly extended out of said light casing for coupling to the ceiling so as to separate said light casing from said ceiling.

6. The recessed light apparatus, as recited in claim 5, wherein said light casing further has an outer wall surface and an inner wall surface, wherein said light casing has a receiving cavity to receive said heat sink therein at a position that said heat sink does not contact with said light casing, such that said light casing forms a heat dissipating space for dissipating heat from said heat sink.

* * * * *